US008292388B2

(12) United States Patent
Matsushita et al.

(10) Patent No.: US 8,292,388 B2
(45) Date of Patent: Oct. 23, 2012

(54) LIQUID EJECTING APPARATUS AND METHOD OF MANUFACTURING LIQUID EJECTING APPARATUS

(75) Inventors: Junichiro Matsushita, Matsumoto (JP); Shuji Yonekubo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 257 days.

(21) Appl. No.: 12/727,108

(22) Filed: Mar. 18, 2010

(65) Prior Publication Data

US 2010/0238218 A1 Sep. 23, 2010

(30) Foreign Application Priority Data

Mar. 19, 2009 (JP) ..... 2009-068614

(51) Int. Cl.
*B41J 29/38* (2006.01)
*B41J 2/045* (2006.01)

(52) U.S. Cl. ..... 347/10; 347/70

(58) Field of Classification Search ..... 347/10, 347/11, 15

See application file for complete search history.

(56) References Cited

U.S. PATENT DOCUMENTS 6,364,444 B1 * 4/2002 Ota ..... 347/10
6,779,866 B2 8/2004 Junhua et al.

FOREIGN PATENT DOCUMENTS

JP 2001-129992 5/2001
JP 2005-125804 5/2005

* cited by examiner

*Primary Examiner* — Geoffrey Mruk
(74) *Attorney, Agent, or Firm* — Workman Nydegger

(57) ABSTRACT

A liquid ejecting apparatus includes a driving element driven by a driving waveform and a nozzle that ejects liquid in response to the driving element. A driving signal generator generates the driving waveforms in a period and creates a driving signal in which the driving waveforms are repeatedly generated in each period. The driving signal generator creates the driving signal in which at least two first driving waveforms configured to eject the maximum amount of liquid among amounts of liquid ejected from the nozzle once in the period and at least two second driving waveforms configured to eject a different amount of liquid are generated in each period. The driving signal is such that a temporal interval at which the first driving waveform is generated is closer to the half length of the period than a temporal interval at which the second driving waveform is generated.

2 Claims, 17 Drawing Sheets

| | | | | | | SELECTION DATA |
|---|---|---|---|---|---|---|
| | MINUTE VIBRATION 0 pl | COM(1) | T11 × | T12 × | T13 × | q0(000) |
| | | COM(2) | T14 × | T15 ○ | T16 × | q6(010) |
| 1.6 pl | TINY DOT 1.6 pl | COM(1) | T11 × | T12 × | T13 ○ | q1(001) |
| | | COM(2) | T14 × | T15 × | T16 × | q7(000) |
| 0.9 pl | SMALL DOT 2.5 pl | COM(1) | T11 × | T12 ○ | T13 × | q2(010) |
| | | COM(2) | T14 × | T15 × | T16 × | q8(000) |
| 2.5 pl | MIDDLE DOT 5 pl | COM(1) | T11 × | T12 × | T13 × | q3(000) |
| | | COM(2) | T14 ○ | T15 × | T16 × | q9(100) |
| 5 pl | LARGE DOT 10 pl | COM(1) | T11 ○ | T12 × | T13 × | q4(100) |
| | | COM(2) | T14 × | T15 × | T16 × | q10(000) |
| 10 pl | MAXIMUM DOT 20 pl | COM(1) | T11 ○ | T12 × | T13 × | q5(100) |
| | | COM(2) | T14 × | T15 × | T16 ○ | q11(001) |

FIG. 12

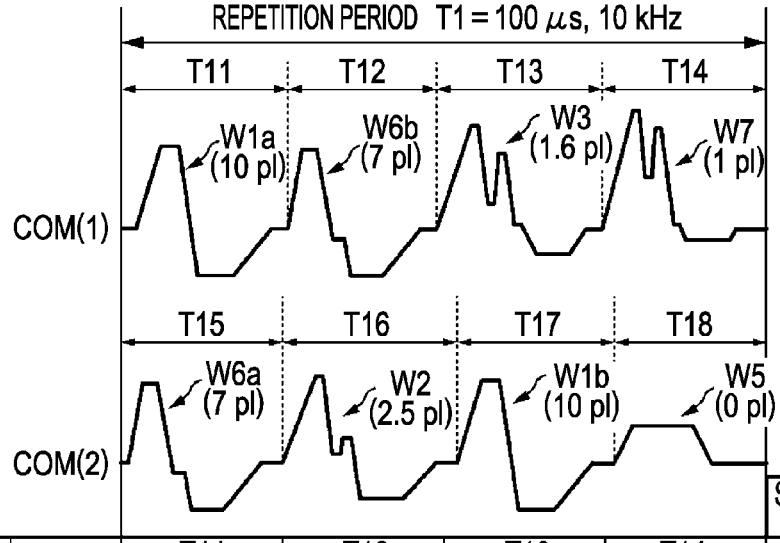

| | | | | | | | SELECTION DATA |
|---|---|---|---|---|---|---|---|
| | MINUTE VIBRATION | COM(1) | T11 | T12 | T13 | T14 | q0(0000) |
| | | | × | × | × | × | |
| | 0 pl | COM(2) | T15 | T16 | T17 | T18 | q8(0001) |
| | | | × | × | × | ○ | |
| 1 pl | FIRST DOT | COM(1) | T11 | T12 | T13 | T14 | q1(0001) |
| | | | × | × | × | ○ | |
| | 1 pl | COM(2) | T15 | T16 | T17 | T18 | q9(0000) |
| | | | × | × | × | × | |
| 0.6 pl | SECOND DOT | COM(1) | T11 | T12 | T13 | T14 | q2(0010) |
| | | | × | × | ○ | × | |
| | 1.6 pl | COM(2) | T15 | T16 | T17 | T18 | q10(0000) |
| | | | × | × | × | × | |
| 0.9 pl | THIRD DOT | COM(1) | T11 | T12 | T13 | T14 | q3(0000) |
| | | | × | × | × | × | |
| | 2.5 pl | COM(2) | T15 | T16 | T17 | T18 | q11(0100) |
| | | | × | ○ | × | × | |
| 4.5 pl | FOURTH DOT | COM(1) | T11 | T12 | T13 | T14 | q4(0000) |
| | | | × | × | × | × | |
| | 7 pl | COM(2) | T15 | T16 | T17 | T18 | q12(1000) |
| | | | ○ | × | × | × | |
| 3 pl | FIFTH DOT | COM(1) | T11 | T12 | T13 | T14 | q5(0000) |
| | | | × | × | × | × | |
| | 10 pl | COM(2) | T15 | T16 | T17 | T18 | q13(0010) |
| | | | × | × | ○ | × | |
| 4 pl | SIXTH DOT | COM(1) | T11 | T12 | T13 | T14 | q6(0100) |
| | | | × | ○ | × | × | |
| | 14 pl | COM(2) | T15 | T16 | T17 | T18 | q14(1000) |
| | | | ○ | × | × | × | |
| 6 pl | SEVENTH DOT | COM(1) | T11 | T12 | T13 | T14 | q7(1000) |
| | | | ○ | × | × | × | |
| | 20 pl | COM(2) | T15 | T16 | T17 | T18 | q15(0010) |
| | | | × | × | ○ | × | |

LIQUID EJECTING APPARATUS AND METHOD OF MANUFACTURING LIQUID EJECTING APPARATUS

BACKGROUND

1. Technical Field

The present invention relates to a liquid ejecting apparatus and a method of manufacturing the liquid ejecting apparatus.

2. Related Art

There is known an ink jet printer which ejects ink (liquid) from a nozzle corresponding to a driving element, by applying a driving waveform to the driving element. By varying the shape of the driving waveform applied to the driving element, it is possible to vary the amount of ink ejected from the nozzle.

In order to improve the granularity of a print image, it is preferable the kinds of amounts of ink ejected from the nozzle may be made various or the variation in the amount of ink ejected from the nozzle may decrease. There is known an ink jet printer which performs printing by using a driving signal which generates a driving waveform with plural shapes in a repetition period in order to eject the plural kinds of amounts of ink from nozzle (see JP-A-2005-125804).

The driving waveform configured to eject a predetermined amount of ink from nozzles with a certain size is generated twice in the repetition period. In this case, by generating one driving waveform in each of the first half and the second half of the repetition period, it is possible to arrange dots formed with predetermined amounts of ink in pixels in a balanced manner.

When one transformed driving waveform configured to eject another amount of ink close to the predetermined amount of ink is generated in each of the first half and the second half of the repetition period in order to improve granularity, the meniscus of the nozzles at a high frequency area becomes unstable. Consequently, a problem may arise in that an exact amount of ink is not ejected. However, when the ink is ejected by a first transformed driving waveform and then a second transformed driving waveform is not generated in the repetition period until the meniscus becomes stable, the repetition period becomes longer and thus a print time (liquid ejection time) becomes longer.

SUMMARY

An advantage of some aspects of the invention is that it provides a technique for improving the granularity of an image while shortening a liquid ejection time.

According to an aspect of the invention, there is provided a method of manufacturing a liquid ejecting apparatus which drives a driving element by applying a driving waveform and ejects a liquid from a nozzle corresponding to the driving element. The method includes: preparing data to create a driving signal in which a plurality of the driving waveforms is generated in a predetermined period and the plurality of driving waveform is generated in each predetermined period, the driving signal being created such that at least two first driving waveforms configured to eject the maximum amount of liquid among amounts of liquid ejected from the nozzle once in the predetermined period and at least two second driving waveforms configured to eject another amount of liquid different from the maximum amount of liquid are generated in each predetermined period, and being created such that a temporal interval at which the first driving waveform is generated is closer to the half length of the predetermined period than a temporal interval at which the second driving waveform is generated; and storing the data configured to create the driving signals in a memory of the liquid ejecting apparatus.

According to another aspect of the invention, there is provided a liquid ejecting apparatus including: a driving element which is driven by a driving waveform; a nozzle from which a liquid is ejected by driving the driving element; a driving signal generator which generates a plurality of the driving waveforms in a predetermined period and creates a driving signal in which the plurality of driving waveforms is repeatedly generated in each predetermined period; and a controller which permits the driving signal generator to create the driving signal in which at least two first driving waveforms configured to eject the maximum amount of liquid among amounts of liquid ejected from the nozzle once in the predetermined period and at least two second driving waveforms configured to eject an amount of liquid different from the maximum amount of liquid are generated in each predetermined period, the driving signal being generated such that a temporal interval at which the first driving waveform is generated is closer to the half length of the predetermined period than a temporal interval at which the second driving waveform is generated.

Other aspects of the invention are apparent from the description of the specification and the accompanying drawings.

BRIEF DESCRIPTION OF THE DRAWINGS

The invention will be described with reference to the accompanying drawings, wherein like numbers reference like elements.

FIG. 12 is a diagram illustrating a relationship between the driving signal according to this embodiment and selection data.

DESCRIPTION OF EXEMPLARY EMBODIMENTS

Summary of Disclosure

Figure 1A:
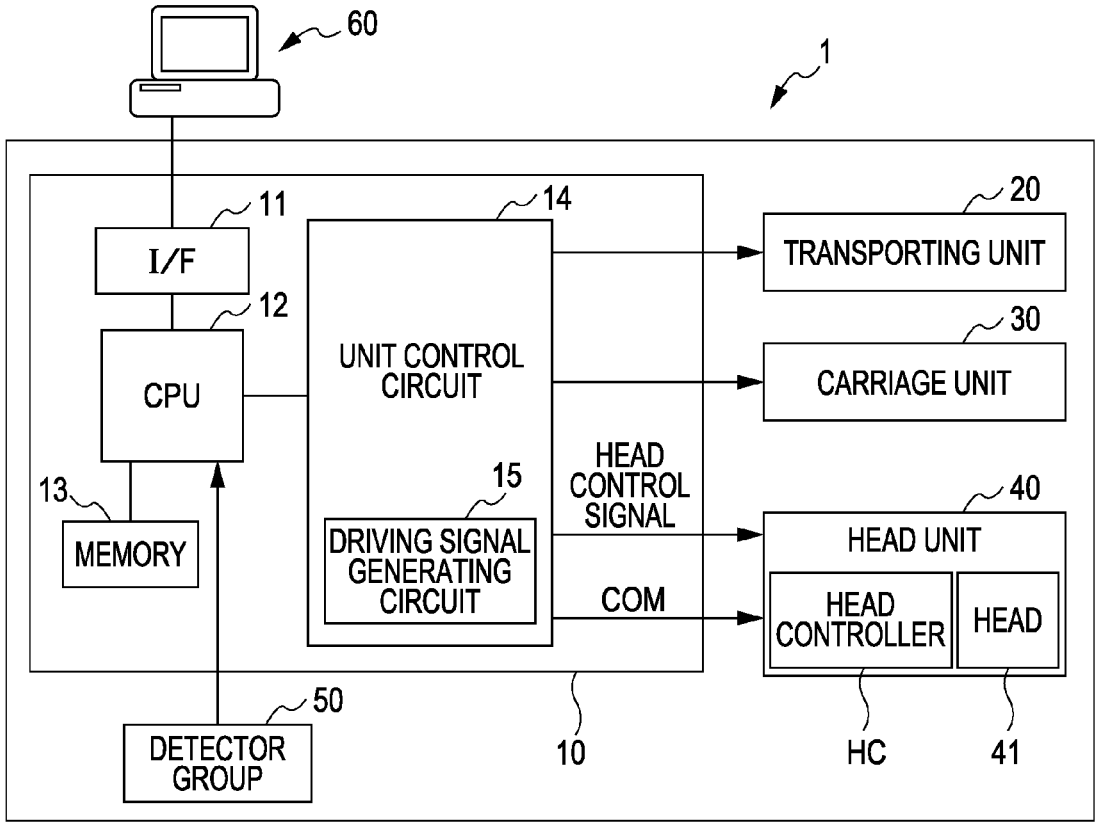
FIG. 1A is a block diagram illustrating the overall configuration of a printer according to an embodiment.

The following aspects are apparent from the description of the specification and the accompanying drawings.

According to an aspect of the invention, there is provided a method of manufacturing a liquid ejecting apparatus which drives a driving element by applying a driving waveform and ejects a liquid from a nozzle corresponding to the driving element. The method includes: preparing data to create a driving signal in which a plurality of the driving waveforms is generated in a predetermined period and the plurality of driving waveform is generated in each predetermined period, the driving signal being created such that at least two first driving waveforms configured to eject the maximum amount of liquid among amounts of liquid ejected from the nozzle once in the predetermined period and at least two second driving waveforms configured to eject another amount of liquid different from the maximum amount of liquid are generated in each predetermined period, and being created such that a temporal interval at which the first driving waveform is generated is closer to the half length of the predetermined period than a temporal interval at which the second driving waveform is generated; and storing the data configured to create the driving signals in a memory of the liquid ejecting apparatus.

According to the method of manufacturing the liquid ejecting apparatus, it is possible to improve the granularity of an image, while shortening a liquid ejection time.

In the method of manufacturing the liquid ejecting apparatus, a result may be acquired by varying a temporal interval, at which the two second driving waveforms are generated in the predetermined period, a plural number of times and measuring the amount of liquid ejected from the nozzle. The temporal interval, at which the two second driving waveforms are generated in the predetermined period of the driving signal, may be determined on the basis of the result.

According to the method of manufacturing the liquid ejecting apparatus, it is possible to eject a desired amount of liquid, even when it is difficult to suppress residual vibration of a meniscus after the ejection of the liquid by the second driving waveform.

In the method of manufacturing the liquid ejecting apparatus, the temporal interval, at which the two second driving waveforms are generated in the predetermined period of the driving signal, may be determined on the basis of the amount of liquid ejected from the nozzle and the length of the temporal interval, at which the two second driving waveforms are generated, in the result.

According to the method of manufacturing the liquid ejecting apparatus, it is possible to improve a freedom of design of another driving waveform.

In the method of manufacturing the liquid ejecting apparatus, the temporal interval, at which the two second driving waveforms are generated in the predetermined period of the driving signal, may be determined on the basis of the amount of liquid ejected from the nozzle and a liquid ejection feature regarding each temporal interval, at which the two second driving waveforms are generated, in the result.

According to the method of manufacturing the liquid ejecting apparatus, it is possible to improve image quality.

In the method of manufacturing the liquid ejecting apparatus, the temporal interval, at which the two second driving waveforms are generated in the predetermined period of the driving signal, may be determined on the basis of the amount of liquid ejected from the nozzle and a variation in an ejection amount of liquid at each temporal interval, at which the two second driving waveforms are generated, in the result.

According to the method of manufacturing the liquid ejecting apparatus, it is possible to eject the amount of liquid close to another amount of liquid by the second driving waveform, even when an error occurs upon generating the driving signal.

In the method of manufacturing the liquid ejecting apparatus, the maximum amount of liquid may be an amount of liquid between the another amount of liquid and a double of the another amount of liquid.

According to the method of manufacturing the liquid ejecting apparatus, it is possible to improve the granularity of an image.

In the method of manufacturing the liquid ejecting apparatus, the driving waveform generated by the first driving signal and the driving waveform generated by the second driving signal may be applicable to the same driving element. One first driving waveform and one second driving waveform may be generated by the first driving signal and the second driving signal, respectively.

According to the method of manufacturing the liquid ejecting apparatus, it is possible to disperse an amount of heat generated in a driving signal generator.

According to another aspect of the invention, there is provided a liquid ejecting apparatus including: a driving element which is driven by a driving waveform; a nozzle from which a liquid is ejected by driving the driving element; a driving signal generator which generates a plurality of the driving waveforms in a predetermined period and creates a driving signal in which the plurality of driving waveforms is repeatedly generated in each predetermined period; and a controller which permits the driving signal generator to create the driving signal in which at least two first driving waveforms configured to eject the maximum amount of liquid among amounts of liquid ejected from the nozzle once in the predetermined period and at least two second driving waveforms configured to eject an amount of liquid different from the maximum amount of liquid are generated in each predetermined period, the driving signal being generated such that a temporal interval at which the first driving waveform is generated is closer to the half length of the predetermined period than a temporal interval at which the second driving waveform is generated.

According to the liquid ejecting apparatus, the temporal interval at which the second driving waveform is set that an amount of liquid ejected by two second waveforms equals to twice of an amount of liquid ejected by one second wave form.

According to the method of manufacturing the liquid ejecting apparatus, it is possible to improve the granularity of an image, while shortening a liquid ejection time.

Ink Jet Printer

Hereinafter, an ink jet printer will be described as an example of a liquid ejecting apparatus, and a serial type printer (hereinafter, referred to as a printer 1) of the ink jet printer will be described.

Figure 1B:
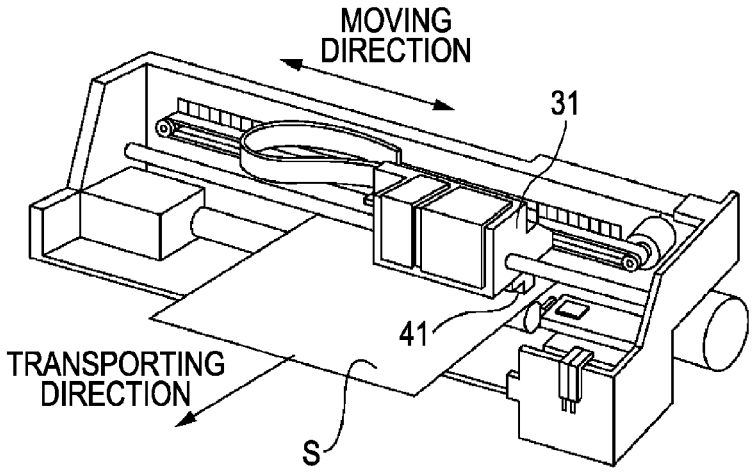
FIG. 1B is a perspective view illustrating a part of the printer.

FIG. 1A is a block diagram illustrating the overall configuration of the printer 1 according to an embodiment. FIG. 1B is a perspective view illustrating a part of the printer 1. In the printer 1 receiving print data from a computer 60 serving as an external apparatus, a controller 10 controls units (a transporting unit 20, a carriage unit 30, and a head unit 40) to form an image on a sheet S (medium). A detector group 50 detects the status of the printer 1. The controller 10 controls the units on the basis of the detection result.

The controller 10 is a unit which controls the printer 1. An interface unit 11 is a unit which transmits and receives data between the computer 60 serving as the external apparatus and the printer 1. A CPU 12 is an arithmetic processing unit which controls the entire printer 1. A memory 13 is a unit which ensures a region for storing the programs of the CPU 12, a working region, or the like. The CPU 12 controls the units by a unit control circuit 14.

The transporting unit 20 is a unit which transports the sheet S to a printable location and transports the sheet S by a predetermined transport amount in a printing direction at print time. The carriage unit 30 is a unit which moves a head 41 mounted on a carriage 31 in a direction (hereinafter, referred to as a moving direction) intersecting the transporting direction of the sheet.

The head unit 40, which ejects ink to the sheet S, includes the head 41 and a head controller HC. A plurality of nozzles serving as an ink ejection unit is formed on the lower surface of the head 41. Ink droplets are ejected from the nozzles corresponding to piezoelectric elements (driving element) which are deformed on the basis of a head control signal from the controller 10 or a driving signal COM generated by a driving signal generating circuit 15.

The printer 1 according to this embodiment forms an image by alternately repeating a dot forming process of intermittently ejecting the ink from the head 41 being moved in the moving direction and forming dots on the sheet S and a transporting process of transporting the sheet S in the transporting direction to form dots at positions different from the positions of the dots formed in the previous dot forming process.

Driving of Head 41

Configuration of Head 41

Figure 2A:
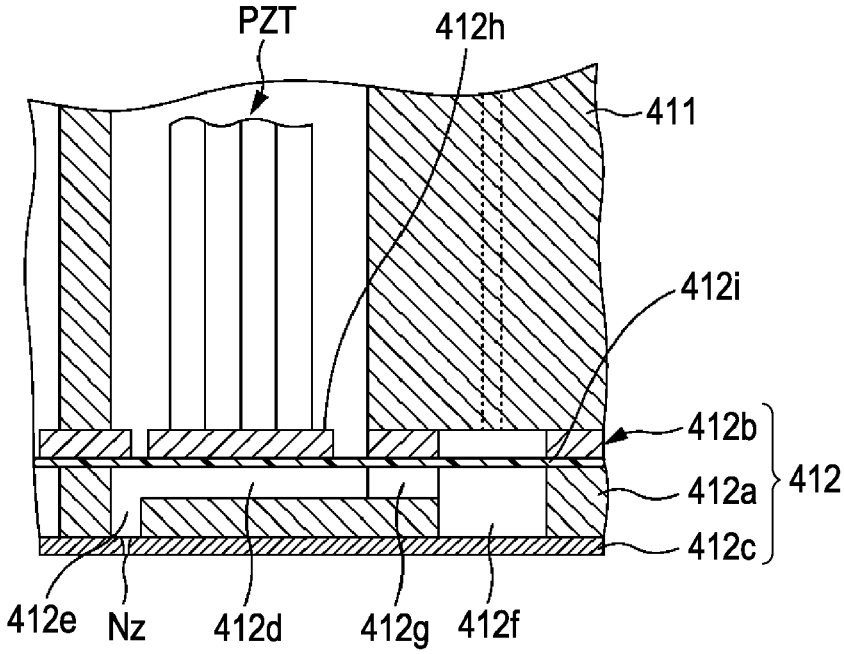
FIG. 2A is a sectional view illustrating a head.

FIG. 2A is a sectional view illustrating the head 41. The main body of the head 41 includes a case 411, a passage unit 412, and a piezoelectric element group PZT. The case 411 accommodates the piezoelectric element group PZT. The passage unit 412 is joined to the lower surface of the case 411.

The passage unit 412 includes a passage forming plate 412*a*, an elastic plate 412*b*, and a nozzle plate 412*c*. The passage forming plate 412*a* has a groove which becomes a pressure chamber 412*d*, a through port which becomes a nozzle communication port 412*e*, a through port which becomes a common ink chamber 412*f*, and a groove which becomes an ink supply passage 412*g*. The elastic plate 412*b* includes an island portion 412*h* to which the front end of the piezoelectric element group PZT is joined. An elastic region by an elastic film 412*i* is formed in the circumference of the island portion 412*h*. The ink stored in an ink cartridge is supplied to the pressure chamber 412*d* corresponding to each nozzle Nz via the common ink chamber 412*f*. The nozzles Nz ejecting the ink are formed in the nozzle plate 412*c*.

Figure 2B:
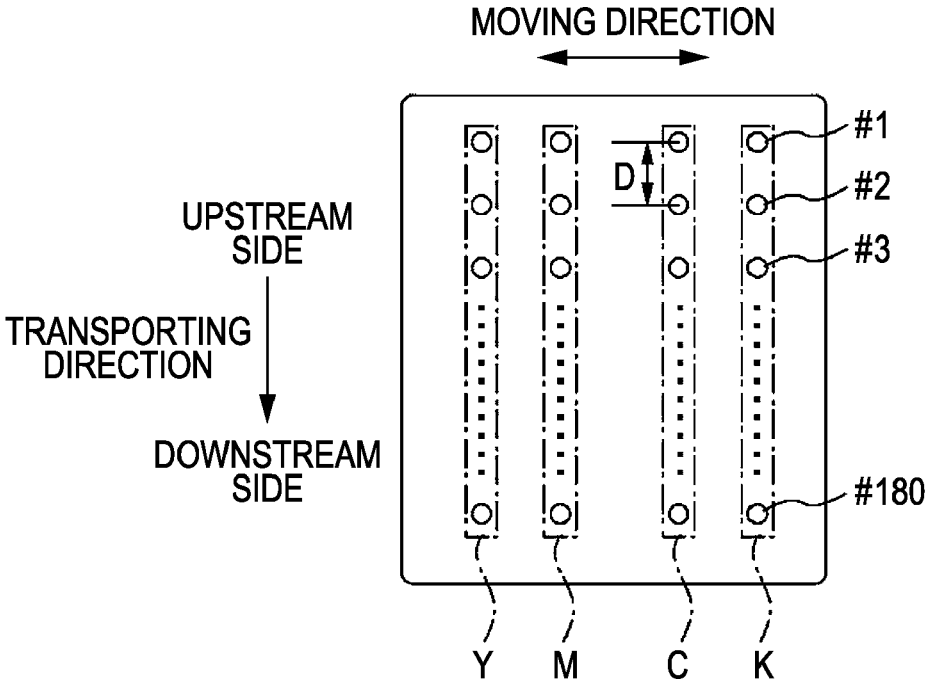
FIG. 2B is a diagram illustrating a nozzle surface of the head.

FIG. 2B is a diagram illustrating a nozzle surface of the head 41. Four nozzle rows in which 180 nozzles are arranged at a predetermined interval D in the transporting direction are formed on the nozzle surface. Ink of different colors is ejected from the nozzle rows. The four nozzle rows include a yellow nozzle row Y ejecting yellow ink, a magenta nozzle row M ejecting magenta ink, a cyan nozzle row C ejecting cyan ink, and a block nozzle row K ejecting black ink.

The piezoelectric element group PZT has plural pectinate piezoelectric elements (driving element) of which the number corresponds to the number of the nozzles Nz. The piezoelectric element group PZT vertically contracts or expands in accordance with the potential of the driving signal COM by a wiring board (not shown) mounted with the head controller HC, when the driving signal COM is applied to the piezoelectric element group PZT (hereinafter, referred to as a piezoelectric element). When the piezoelectric element group PZT contracts, the island portion 412*h* is pushed toward the pressure chamber 412*d* or pulled toward an opposite direction of the pressure chamber 412*d*. At this time, the elastic film 412*i* in the circumference of the island portion 412*h* is deformed and the pressure in the pressure chamber 412*d* increases or decreases to eject the ink droplets from the nozzles.

Driving Signal Generating Circuit

Figure 3:
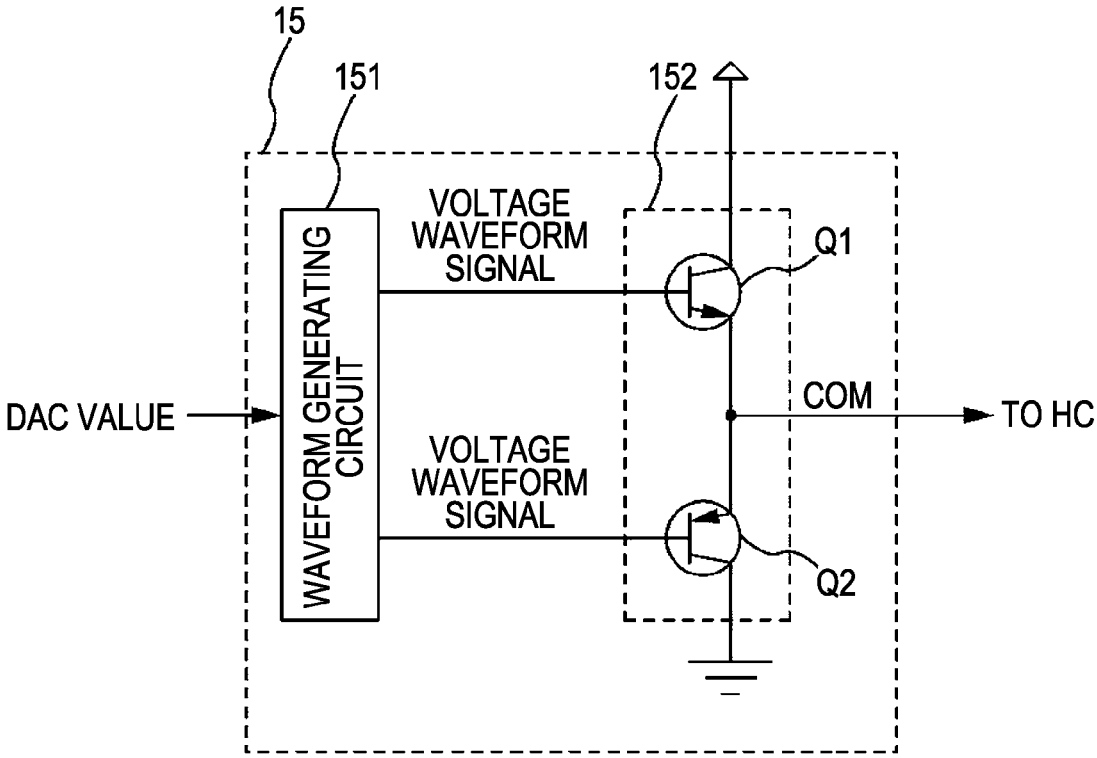
FIG. 3 is a diagram illustrating a driving signal generating circuit generating a driving signal.

FIG. 3 is a diagram illustrating the driving signal generating circuit 15 (corresponding to a driving signal generator) which generates the driving signal COM. The driving signal generating circuit 15 includes a waveform generating circuit 151 and a current amplifying circuit 152. The waveform generating circuit 151 generates a voltage waveform signal (waveform information of an analog signal), which is a base of the driving signal COM, on the basis of a DAC value (waveform information of a digital signal). The current amplifying circuit 152 amplifies the current of the voltage waveform signal and outputs the current of the voltage waveform signal as the driving signal COM. The driving signal COM is commonly used to eject the ink from the nozzles belonging to a certain nozzle row (nozzle row). The invention is not limited to a DAC circuit (digital circuit), but an analog circuit may be used.

The current amplifying circuit 152 includes an increasing transistor Q1 (NPN-type transistor) operating when the voltage of the driving signal COM increases and a decreasing transistor Q2 (PNP-type transistor) operating when the voltage of the driving signal COM decreases. In the increasing transistor Q1, a collector is connected to a power source and an emitter is connected to an output signal line of the driving signal COM. In the decreasing transistor Q2, a collector is connected to a ground wire and an emitter is connected to the output signal line of the driving signal COM.

When the increasing transistor Q1 turns on by the voltage waveform signal from the waveform generating circuit 151, the driving signal COM increases to charge the piezoelectric element PZT. On the other hand, when the decreasing transistor Q2 turns on by the voltage waveform signal, the driving signal COM decreases to charge the piezoelectric element PZT. In this way, the driving signal is generated to eject the ink droplets from the nozzles.

Head Controller HC

Figure 4:
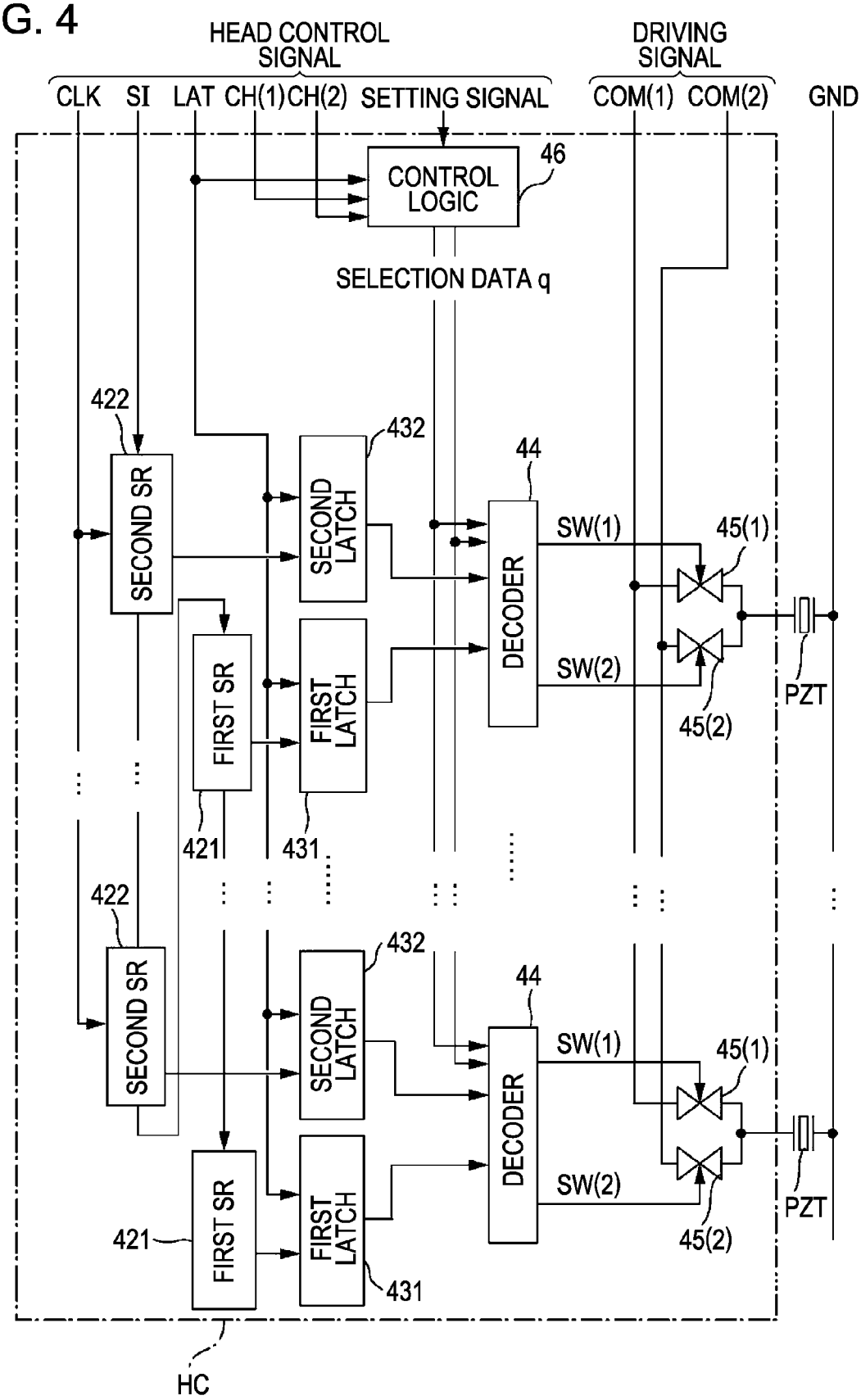
FIG. 4 is a diagram illustrating a head controller.

FIG. 4 is a diagram illustrating the head controller HC. In the head controller HC, each piezoelectric element (group) PZT includes a first shift register 421, a second shift register 422, a first latch circuit 431, a second latch circuit 432, a decoder 44, a first switch 45(1), a second switch 45(2), and a control logic 46.

For easy description, it is assumed that, for example, 2-bit dot formation data SI is sent from the controller 10 to the head controller HC in one pixel (which is a unit region set imaginarily on a sheet). In the embodiment described below, since there are many kinds of dots formed in one pixel, the number of dot forming data SI correspondingly increases. The upper bit of the dot formation data SI is set in the first shift register 421 and the lower bit of the dot formation data SI is set in the second shift register 422. At time defined in a latch signal LAT, the first latch circuit 431 latches the data set in the first shift register 421 and the second latch circuit 432 latches the data set in the second shift register 422. The dot formation data SI transmitted in serial form are paired with each nozzle Nz by latching the data by the first latch circuit 431 and the second latch circuit 432. The decoder 44 performs decoding on the basis of the dot formation data SI from the first latch circuit 431 and the second latch circuit 432 and outputs switch control signals SW(1) and SW(2) to control the first switch 45(1) and the second switch 45(2), respectively. The switch control signals SW are selected from plural kinds of selection data q (which are described below) output from the control logic 46. Here, two driving signals COM(1) and COM(2) (which are described below) are input to one head controller HC. The first switch 45(1) controls the application of the first driving signal COM(1) to the piezoelectric element on the basis of the first switch control signal SW(1). The second switch 45(2) controls the application of the second driving signal COM(2) to the piezoelectric element on the basis of the second switch control signal SW(2).

Driving Signal COM According to Comparative Example

Figure 5:
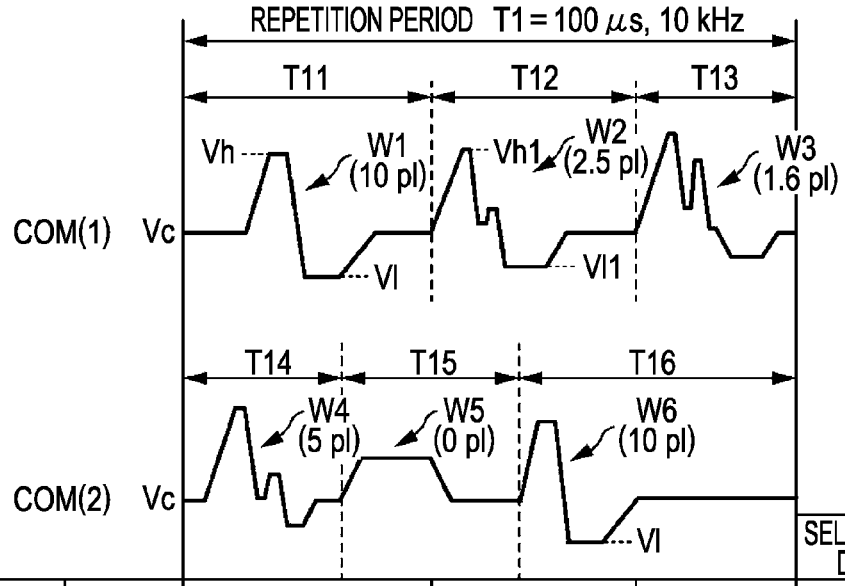
FIG. 5 is a diagram illustrating first and second driving signals according to a comparative example.

FIG. 5 is a diagram illustrating the first driving signal COM(1) and the second driving signal COM(2) according to a comparative example. According to the comparative example, five kinds of amounts of ink are ejected from one nozzle to form five kinds of dots for one pixel. The five kinds of dots include a tiny dot (1.6 pl), a small dot (2.5 pl), a middle dot (5 pl), a large dot (10 pl), and a maximum dot (20 pl). That is, according to the comparative example, six gray scales can be expressed for one pixel, including a case where no dot is formed.

In order to make the amount of ink ejected from the nozzle with the same size vary, the shape of the driving waveform W of the driving signal COM may be made different. However, when the number of driving waveforms W increases with the increase in the kinds of amounts of ink ejected from the nozzle, a period (hereinafter, referred to as a repetition period T) in which the driving waveform W is repeatedly generated becomes longer. The repetition period T (corresponding to a predetermined period) corresponds a time at which one nozzle faces one pixel. Therefore, a print time becomes longer, when the repetition period T is longer.

Here, when the plural driving waveforms W are generated dividedly in a first driving signal COM(1) and a second driving signal COM(2), the length of the repetition period T can be shortened. In order to do this, two driving signal generating circuits 15 shown in FIG. 3 are provided for each nozzle row, so that one driving signal generating circuit 15 generates the first driving signal COM(1) and the other driving signal generating circuit 15 generates the second driving signal COM (2). As shown in FIG. 4, the two driving signals COM(1) and COM(2) are input to the head controller HC of a certain nozzle row.

Hereinafter, the first driving signal COM(1) and the second driving signal COM(2) used in the comparative example will be described. FIG. 5 shows the first driving signal COM(1). In a repetition period T1, a first waveform W1 is generated for a period T11, a second waveform W2 is generated for a period T12, and a third waveform W3 is generated for a period T13. On the other hand, in the second driving signal COM(2), a fourth waveform W4 is generated for a period T14, a fifth waveform W5 is generated for a period T15, and a first waveform W1 is generated for a period T16.

Here, when the first waveform W1 is applied to the piezoelectric element, ink of 10 pl is ejected from the nozzle corresponding to this piezoelectric element. When the second waveform W2 is applied to the piezoelectric element, ink of 2.5 pl is ejected from the nozzle corresponding to this piezoelectric element. When the third waveform W3 is applied to the piezoelectric element, ink of 1.6 pl is ejected from the nozzle corresponding to this piezoelectric element. When the fourth waveform W4 is applied to the piezoelectric element, ink of 5 pl is ejected from the nozzle corresponding to this piezoelectric element.

However, even when the fifth waveform W5 is applied to the piezoelectric element, no ink droplet is ejected from the nozzle corresponding to this piezoelectric element and the meniscus (which is a free surface of the ink being exposed from the nozzle) of this nozzle minutely vibrates. For example, when the dot formation data SI corresponding to a certain pixel indicates "no dot", the fifth waveform W5 is applied to the piezoelectric element of the nozzle allocated to the pixel. By doing so, the meniscus of the nozzle minutely vibrates, but the ink droplet is not ejected from the nozzle and thus no dot is formed in this pixel. In this way, even when the ink droplet is not ejected from the nozzle, the dryness of the meniscus can be prevented by minutely vibrating the meniscus of the nozzle. Therefore, the ink ejection can be prevented from failing due to clogging of the nozzle.

When the dot formation data SI indicates "no dot", selection data q0 corresponding to the first driving signal COM(1) is expressed by "000" and selection data q6 corresponding to the second driving signal COM(2) is expressed by "010".

Hereinafter, selection data q0 to q11 will be described. The selection data q0 to q11 are output from the control logic 46 shown in FIG. 4. The selection data selected from the plural selection data q0 to q11 on the basis of the dot formation signal SI correspond to the switch control signals SW(1) and SW(2). The selection data q0 to q5 represent the selection patterns of the driving waveforms (W1, W2, and W3) of the first driving signal COM(1). The selection data q6 to q11 represent the selection patterns of the driving waveforms (W4, W5, and W1) of the second driving signal COM(2).

Since both the first driving signal COM(1) and the second driving signal COM(2) have three driving waveforms W and the repetition period T1 is divided into three periods (T11 to T11 and T14 to T16) in the first driving signal COM(1) and the second driving signal COM(2), respectively, the selection data q0 to q11 are expressed by three bits. The detail (whether a driving waveform is applied) of the selection data q0 to q11 is switched at conversion time of each period (T11 to T16). When the selection data is "0", the driving waveform corresponding to this period is not applied to the piezoelectric element. When the selection data is "1", the driving waveform corresponding to this period is not applied to the piezoelectric element.

When the dot formation data SI indicates "tiny dot formation", the selection data q1 of the first driving signal COM(1) is expressed by "001" and the selection data q7 of the second driving signal COM(2) is expressed by "000". Therefore, the third waveform W3 is applied to the corresponding piezoelectric element. By doing so, the ink of 1.6 pl corresponding to the tiny dot is ejected from the nozzle. Likewise, when the dot formation data SI indicates "small dot formation", the second waveform W2 is applied to the corresponding piezoelectric element and the ink of 2.5 pl is ejected from the nozzle. When the dot formation data SI indicates "middle dot formation", the fourth waveform W4 is applied to the corresponding piezoelectric element and the ink of 5 pl is ejected from the nozzle. When the dot formation data SI indicates "large dot formation", the first waveform W1 is applied to the corresponding piezoelectric element and the ink of 10 pl is ejected from the nozzle. When the dot formation data SI indicates "maximum dot formation", the two first waveforms W1 is applied to the corresponding piezoelectric element and the ink of 20 pl is ejected from the nozzle.

That is, as for the tiny dot, the small dot, the middle dot, and the large dot, the amount of ink ejected from the nozzle is made different by changing the shape of the driving waveform W applied to the piezoelectric element. As for the large dot and the maximum dot, the amount of ink ejected from the nozzle is made different by changing the number of driving waveforms (the first waveforms W1) applied to the piezoelectric element.

The amount of ink which can be ejected from the nozzle forming the tiny dot once is restrictive. Here, when the maximum dot is formed, the ink is ejected from the nozzles twice. That is, in order to form the maximum dot, the driving waveforms (here, the first waveforms W1) are applied successively to the piezoelectric element for the period of the same repetition period T. Therefore, the driving waveform applied successively to the piezoelectric element is set as a driving waveform in which the meniscus after the ink ejection becomes stable easily and which a large amount of ink is ejected from the nozzle to form the maximum dot.

The maximum dot is formed in printing (so-called solid printing) of forming an image in a predetermined region on the sheet, since the largest amount of ink ejected toward one pixel is used for the maximum dot. In terms of high speed printing, it is important to perform the solid printing at a high speed. For this reason, the driving waveform used to eject the maximum amount of ink from the nozzle once in the repetition period T is set such that the meniscus after the ink ejection becomes stable easily and the driving waveform can be used even in a high frequency area. That is, the driving waveform may be designed so that the stable amount of ink can be obtained and the repetition period T is shortened as small as possible even when the driving waveform used to eject the maximum amount of ink is applied twice for the repetition period T in order to perform the solid printing at a high speed.

Hereinafter, the driving waveform (here, the first waveform W1) configured so that the maximum amount of ink is ejected from one nozzle once in the repetition period T and configured so that the meniscus after the ink ejection becomes stable easily is referred to as "a basic waveform".

The first waveform W1 serving as the basic waveform first increases from a middle potential Vc to the highest potential Vh, as shown in FIG. 5. Accordingly, the piezoelectric element PZT shown in FIGS. 2A and 2B contracts in its longitudinal direction and the pressure chamber 412*d* filled with the ink expands. After the expansion state of the pressure chamber 412*d* is maintained for a while, the potential decreases from the highest potential Vh to the lowest potential V1 at once. Accordingly, the piezoelectric element PZT expands in its longitudinal direction and the pressure chamber 412*d* contracts to eject an ink droplet from the nozzle.

However, the second waveform W2, the third waveform W3, and the fourth waveform W4 configured to eject an amount of ink smaller than the amount of ink (10 pl) ejected by the first waveform W1 is more complex than the first waveform W1. For example, as shown in FIG. 5, the second waveform W2 increases from the middle potential Vc to the highest potential Vh1, and then does not decrease to the lowest potential Vl1 at once. Instead, the potential decreases from the highest potential Vh1 to the middle potential, increases again, and then decreases to the lowest potential Vl1. In this way, when the ink pillar (meniscus) flying from the nozzle upon first decrease in the potential can be cut small, a small amount of ink can be ejected.

Since the waveform shape of the basic waveform (the first waveform W1) is not more complex than that of the different waveforms (the second waveform W2, the third waveform W3, and the fourth waveform W4), residual vibration of the meniscus after the ink ejection by the basic waveform is smaller than the residual vibration of the meniscus after the ink ejection by the other waveforms. Moreover, the residual vibration can be suppressed easily in a relatively short temporal interval. Accordingly, the plural basic waveforms (the first waveforms W1) can be applied repeatedly to the piezoelectric element at a relatively short temporal interval for the repetition period T. On the contrary, when the waveforms different from the basic waveform are applied repeatedly to the piezoelectric element for the repetition period T, the other driving waveforms are applied to the piezoelectric element for a period during which the residual vibration of the meniscus by the previous ink ejection is not stable. Therefore, an appropriate amount of ink may not be ejected.

Accordingly, when an amount of ink larger than the maximum amount (here, 10 pl) ejected from the nozzle once is ejected for one pixel, it is necessary to apply the plural basic waveforms (the first waveforms W1) to the piezoelectric element, as in the case where the maximum dot (20 pl) is formed.

For this reason, the five kinds of dots are formed in the comparative example. However, as shown in FIG. 5, a difference (10 pl) between the amount of ink used to form the large dot and the amount of ink used to form the maximum dot may be larger than a difference between the amounts of ink used to form the other dots (for example, a difference between the amount of ink used to form the small dot and the amount of ink used to form the middle dot is 2.5 pl). That is, the amounts of ink used to form the tiny dot to the maximum dot increase gradually, but a method (variation in the amount of ink) of increasing the amount of ink used to form the large dot to the maximum dot is numerous more than a method of increasing the amount of ink used to form another small dot to a next larger sized dot. That is, in the driving signal according to the comparative example, the size of the maximum dot sharply increases from the large dot to the maximum dot, whereas the dot size gradually increases from the tiny dot to the large dot.

Improvement in Granularity

In order to improve the granularity of the print image, a method may be used such that the kinds (dot sizes) of amounts of ink ejected from the nozzle increase and the variation (difference between the amounts of ink used to form the respective dots) in the amount of ink is made small. According to the comparative example, the difference of "10 pl" between the amount of ink used to form the large dot and the amount of ink used to form the maximum dot is larger than the variation (for example, 1 pl or 2.5 pl) in the amount of ink used to form the dot smaller than the large dot. The variation "10 pl" in the amount of ink between the large dot and the maximum dot is the maximum amount of ink ejected from the nozzle once. For this reason, the granularity may deteriorate in the density changed from the large dot to the maximum dot.

In this embodiment, the difference in the amounts of ink used to form the dots, that is, the variation in the amount of ink between the small dot and the large dot is aimed to be made as small as possible to improve the granularity of the print image. In particular, a difference between the amount of ink (10 pl) of the large dot formed by the basic waveform (the first waveform W1) and the amount of ink (20 pl) of the maximum dot formed by the two basic waveforms (the first waveforms W1) is aimed to be made small. Specifically, an amount of ink of, for example, 14 pl between the amount of ink of "10 pl" corresponding to the large dot and the amount of ink of "20 pl" corresponding to the maximum dot is ejected to improve the granularity of the print image.

Amount Decreasing Waveform

Figure 6A:
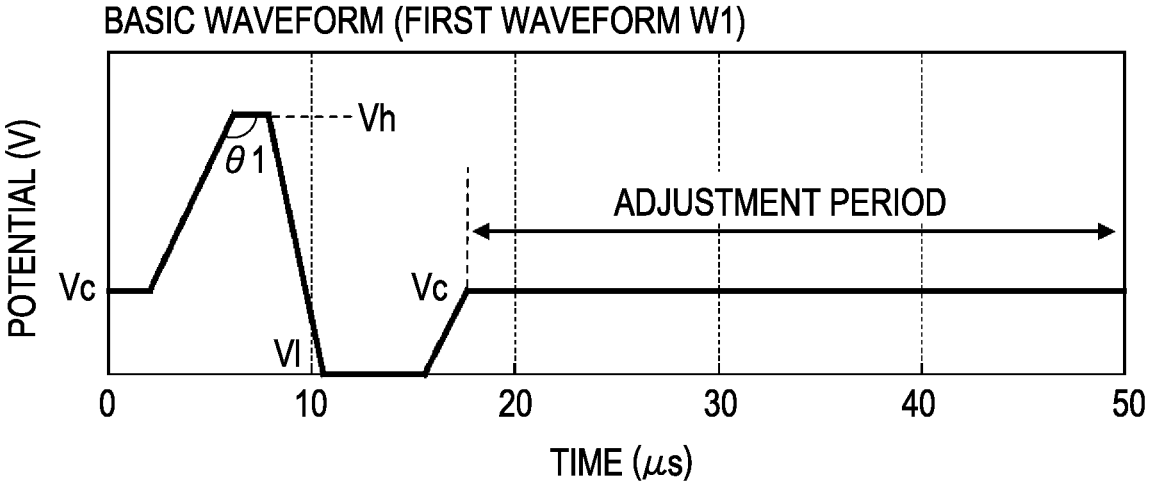
FIG. 6A is a diagram illustrating a basic waveform.
Figure 6B:
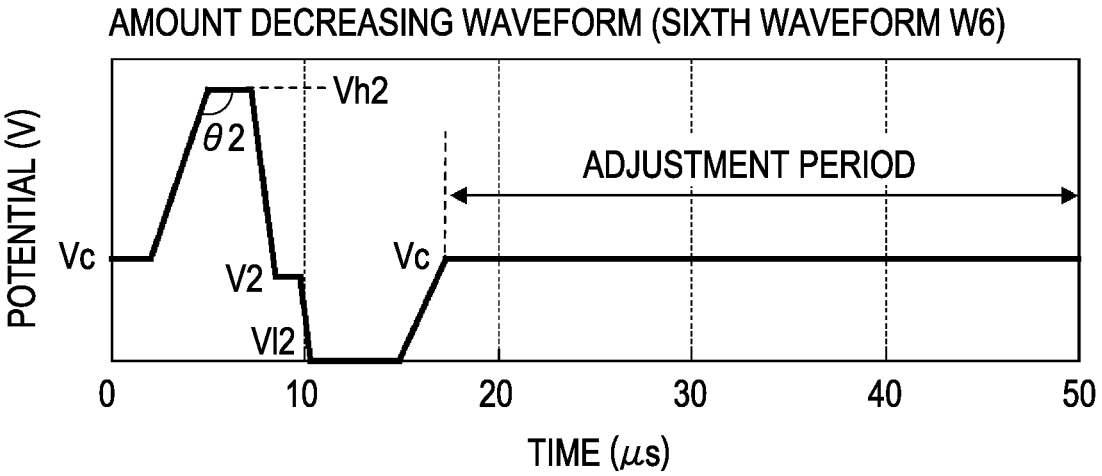
FIG. 6B is a diagram illustrating an amount decreasing waveform.

FIG. 6A is a diagram illustrating the basic waveform (the first waveform W1) configured to eject ink of 10 pl. FIG. 6B is a diagram illustrating the amount decreasing waveform (sixth waveform W6) configured to eject ink of 7 pl from the nozzle with the same size. In FIGS. 6A and 6B, the horizontal axis represents time (μs) and the vertical axis represents a potential variation (V).

Figure 7A:
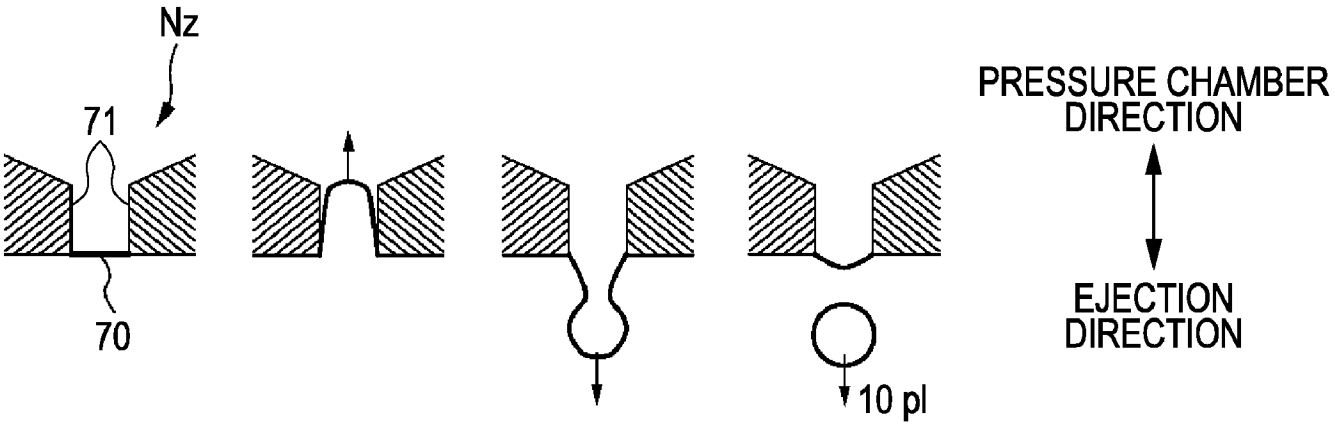
FIGS. 7A and 7B are diagrams illustrating the movement of a meniscus.
Figure 7B:
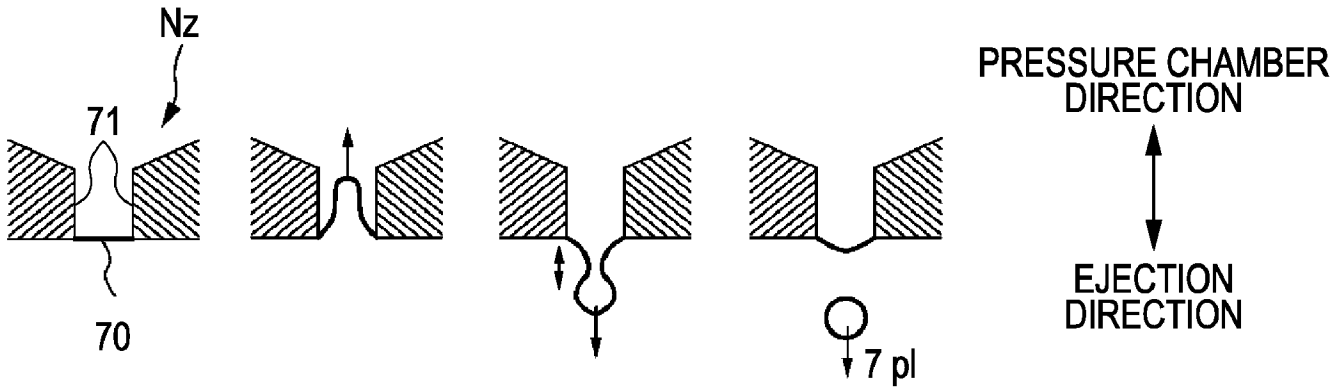

FIG. 7A is a diagram illustrating the movement of a meniscus 70 when the basic waveform W1 is applied to the piezoelectric element. FIG. 7B is a diagram illustrating the movement of the meniscus 70 when the amount decreasing waveform W6 is applied to the piezoelectric element. FIGS. 7A and 7B are the expanded views illustrating the nozzle Nz shown in FIG. 2A. The movement (indicated by a heavy line) of the meniscus 70 on a side wall 71 of the nozzle Nz is shown.

As described above, in the first waveform W1 (FIG. 7A) serving as the basic waveform, the potential increases at a slope θ1 from the middle potential Vc to the highest potential Vh. Accordingly, the piezoelectric element shown in FIGS. 2A and 2B contracts in the longitudinal direction, and thus the pressure chamber 412*d* filled with the ink expands. Then, as shown in FIG. 7A, the meniscus 70 is considerably drawn along the side wall 71 of the nozzle Nz. Subsequently, in the basic waveform, the potential decreases from the highest potential Vh to the lowest potential V1 at once, the piezoelectric element expands in the longitudinal direction, and thus the pressure chamber 412*d* contracts. Then, the meniscus 70 drawn in the pressure chamber direction is pushed out in the ejection direction, the ink pillar extruding from the nozzle Nz is separated, and thus the ink droplet is ejected. After the ink droplet ejection, the potential increases from the lowest potential V1 to the middle potential Vc after a predetermined period expires.

On the other hand, in the amount decreasing waveform (the sixth waveform W6 in FIG. 6B), the potential increases at a slope θ2 from the middle potential Vc to the highest potential Vh2. Then, the pressure chamber 412*d* expands and the meniscus 70 is drawn in the pressure chamber direction. At this time, the slope angle of the potential is larger in the amount decreasing waveform than in the basic waveform (where θ2<θ1). That is, the energy necessary for drawing the meniscus 70 is larger in the amount decreasing waveform than in the basic waveform. The meniscus 70 is drawn strongly and abruptly. Then, as shown in FIG. 7B, a part of the meniscus close to the side wall 71 of the nozzle Nz is drawn less than a middle part of the meniscus away from the side wall 71. Accordingly, the ink pillar formed when the potential decreases from the highest potential Vh2 and the meniscus 70 is pushed out in the ejection direction becomes smaller than the ink pillar when the meniscus is pushed out by the basic waveform.

Moreover, in the amount decreasing waveform, the potential does not decrease from the highest potential Vh2 to the lowest potential V12 at once, but the potential decreases from the highest potential Vh2 to a middle potential V2. In this way, the ink pillar pushed out from the nozzle Nz is not cut at once, but the amount of ink cut from the ink pillar can be adjusted for a maintenance period of the potential V2 so as to be small. After the ink droplet ejection, the potential increases from the lowest potential V1 to the middle potential Vc after a predetermined period expires.

In this way, by changing the method (the method of expanding the pressure chamber 412*d*) of increasing the potential of the basic waveform (the first waveform W1) or the method (the method of contracting the pressure chamber 412*d*) of decreasing the potential, the ink of 7 pl can be ejected also from the nozzle from which the ink of 10 pl is ejected by the basic waveform.

Amount of Ink Ejected by Amount Decreasing Waveform

Figure 8:
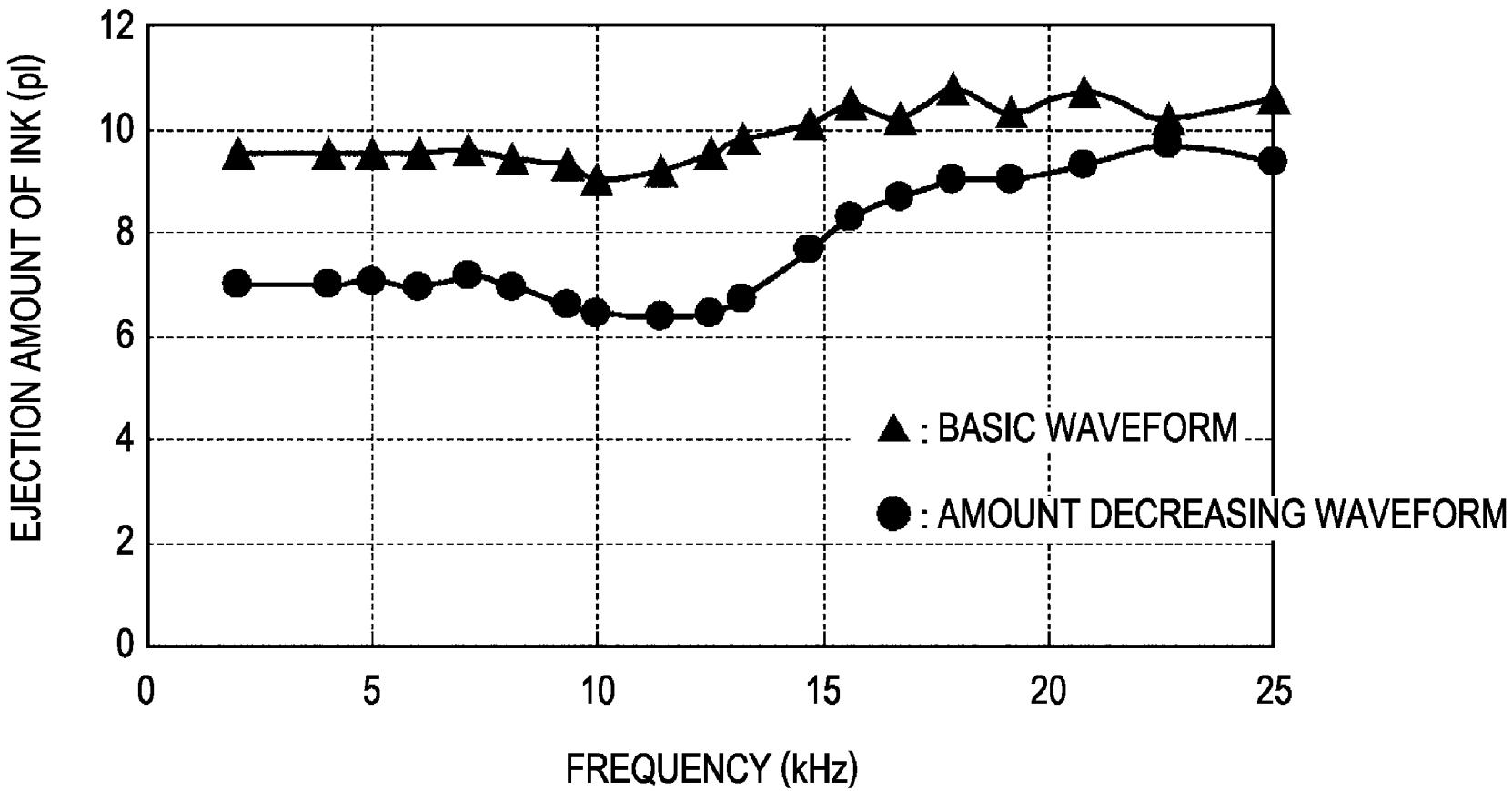
FIG. 8 is a diagram illustrating a measurement result of an ejection amount of ink when a maintenance period of a middle potential is varied.

FIG. 8 is a diagram illustrating the measurement result of the ejection amount of ink when the basic waveform W1 and the amount decreasing waveform W6 are generated by varying the maintenance period (the adjustment period in FIGS. 6A and 6B) of the middle potential Vc after the ink ejection. By varying the adjustment period of the driving waveform, the repetition period T is varied and the frequency of each driving waveform (the basic waveform and the amount decreasing waveform) is thus varied. By lengthening the adjustment period of the driving waveform, the repetition period T becomes longer and the frequency of the driving waveform thus becomes lower. In contrast, by shortening the adjustment period of the driving waveform, the repetition period T becomes shorter and the frequency of the driving waveform thus becomes higher.

In FIG. 8, the horizontal axis represents the frequency (kHz) of each driving waveform and the vertical axis represents the ejection amount of ink (pl). The measurement result of FIG. 8 is an amount of ink ejected from one nozzle once and is an amount of ink ejected after a second time when the ink is repeatedly ejected from the nozzle by the basic waveform or the amount decreasing waveform. The measurement result indicated by a triangle (▲) in the drawing is a measurement result of the ejection amount of ink ejected by the basic waveform W1 in FIG. 6A. The measurement result indicated by a circle (●) in the drawing is a measurement result of the ejection amount of ink ejected by the amount decreasing waveform W6 in FIG. 6B.

For example, an ejection amount of ink corresponding to a frequency of 20 kHz, that is, an ejection amount of ink when the driving waveform is repeatedly generated at the frequency of 20 kHz refers to a measurement result of the ejection amount of ink when the length of the repetition period in which one driving waveform is generated is set to 50 μs including the adjustment period. Likewise, an ejection amount of ink corresponding to a frequency of 10 kHz refers to a measurement result of the ejection amount of ink when the length of the repetition period in which one driving waveform is generated is set to 100 μs.

From the measurement result of FIG. 8, it is known that when the frequencies of the driving waveforms (the basic waveform and the amount decreasing waveform) are set to "10 kHz", that is, when the adjustment period (generation interval of the driving waveform) is relatively long, the ink of about 10 pl is ejected from the nozzle by the basic waveform and the ink of about 7 pl is ejected from the nozzle by the amount decreasing waveform.

When the frequencies of the driving waveforms are set to "20 kHz", that is, when the adjustment period is relatively short, the ink of about 10 pl is ejected from the nozzle by the basic waveform W1, but the ink of about 9 pl larger than 7 pl is ejected from the nozzle by the amount decreasing waveform W6.

That is, in the basic waveform W1, the appropriate amount of ink (10 pl) is ejected even when the adjustment period (the generation period of the driving waveform) is short. In the amount decreasing waveform W6, however, the amount of ink (9 pl) larger than the target amount of ink (7 pl) is ejected when the adjustment period is short. In other words, in the basic waveform, the appropriate amount of ink (10 pl) is ejected even at a high frequency area. In the amount decreasing waveform W6, however, the appropriate amount of ink (7 pl) may not be ejected at the high frequency area. From the measurement result of FIG. 8, it can be known that the amount of ink larger than the target amount of 7 pl is ejected for the amount decreasing waveform when the frequency is equal to or larger than about 15 kHz.

The reason for this phenomenon is considered as follows. That is, as shown in FIGS. 6A and 6B, the slope angle θ2 is larger in the amount decreasing waveform than in the basic waveform when the potential increases from the middle potential Vc to the highest potential Vh2. Moreover, the residual vibration (vibration of ink in the pressure chamber 412*d*) of the meniscus increases after the ink droplet ejection.

Specifically, it is considered that the adjustment period (the generation interval of the driving waveform) is shortened upon generating the amount decreasing waveform successively, the next amount decreasing waveform is applied to the piezoelectric element before the suppression of the residual vibration of the meniscus and thus the meniscus cannot be drawn by a large drawing energy. As a consequence, it is considered that the ink larger than 7 pl is ejected from the nozzle since the energy drawing the meniscus is added to the energy acted in the ejection direction of the ink in the pressure chamber 412*d*.

In the driving signal according to the comparative example, as shown in FIG. 5, there is a large difference between the amount of ink of "10 pl" used to form the large dot by one first waveform W1 (the basic waveform) and the amount of ink of "20 pl" used to form the maximum dot by two first waveforms W1. For this reason, the granularity of the print image deteriorates. Accordingly, in order to improve the granularity of the print image, an amount of ink between 10 pl and 20 pl, for example, the middle amount of ink of 14 pl between 10 pl and 20 pl becomes a target amount. In order to eject the middle amount of ink, it is necessary to generate two amount decreasing waveforms W6 in the repetition period T.

From the measurement result of FIG. 8, it is apparent that the appropriate amount of ink (14 pl) is not ejected when one amount decreasing waveform is not generated at 10 kHz (when the generation interval of the amount decreasing waveform is not set to 100 μs). For this reason, in order to generate two amount decreasing waveforms W6 in the repetition period T, it is necessary to set the length of the repetition period T to 200 μs or larger. Accordingly, the repetition period T1 in the driving signal (see FIG. 5) configured not to eject the ink of 14 pl according to the comparative example is set to 100 μs (10 kHz). That is, in the driving signal configured to generate two amount decreasing waveforms in the repetition period T, the repetition period T is doubled, compared to the driving signal according to the comparative example. Therefore, the print time may be doubled.

On the contrary, when the generation interval of two amount decreasing waveforms is shortened in the repetition period T in order to shorten the print time (for example, when one amount decreasing waveform is generated at 20 kHz), the exact amount of ink may not be ejected and the granularity of the print image may not be improved.

In this way, when the driving signal configured to generate two amount decreasing waveforms at a uniform interval in the repetition period is used to improve the granularity of the print image, a problem may arise in that the print time becomes longer or the exact amount of ink is not ejected.

This embodiment is aiming at improving the granularity of the print image by varying the amount of ink ejected for one pixel as little as possible, while shortening the print time.

Driving Signal COM According to Embodiment

Waveform Interval Δt of Amount Decreasing Waveforms W6

Figure 9:
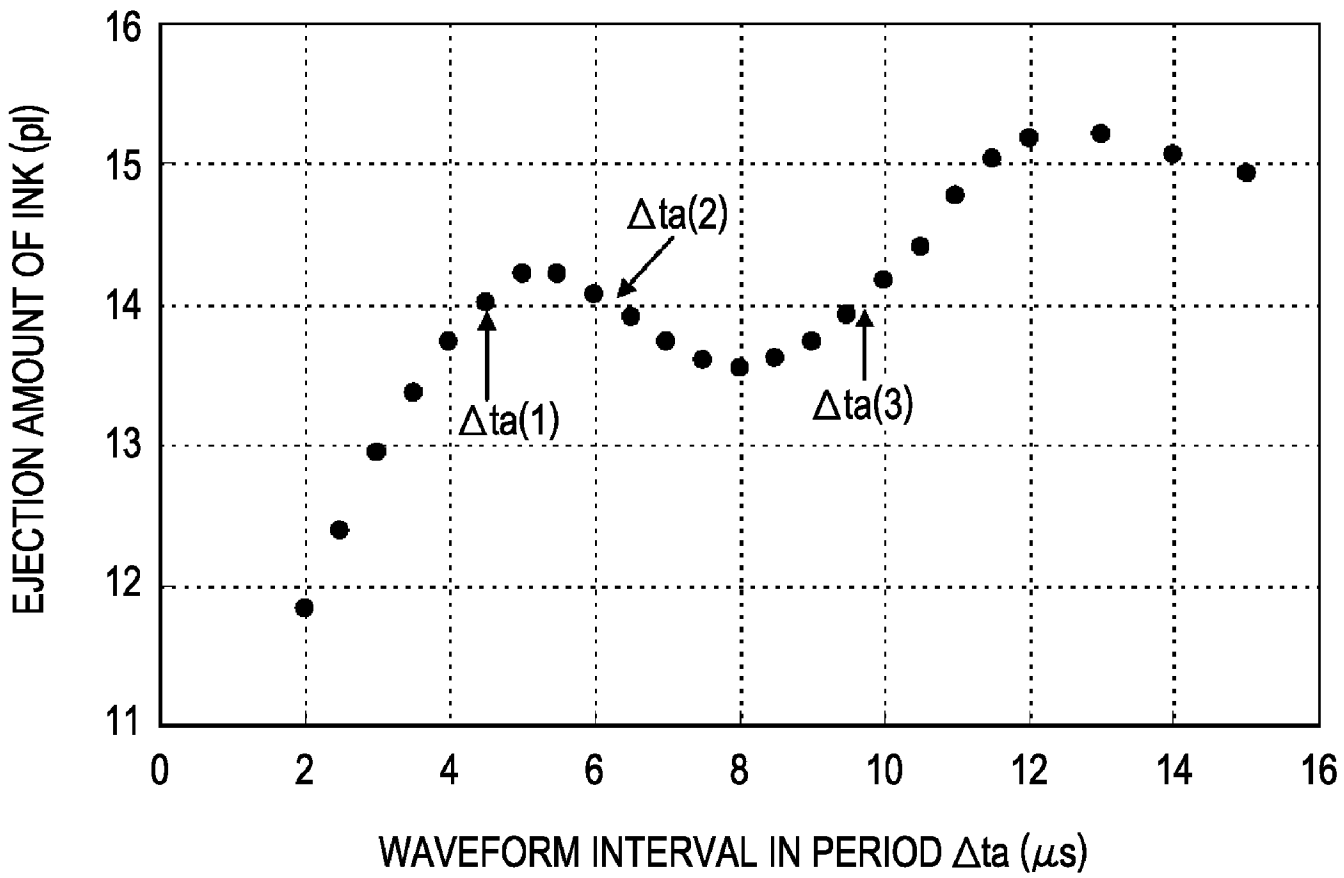
FIG. 9 is a diagram illustrating a measurement result of an ejection amount of ink when a generation interval of the amount decreasing waveforms is varied a plural number of times.
Figure 10A:
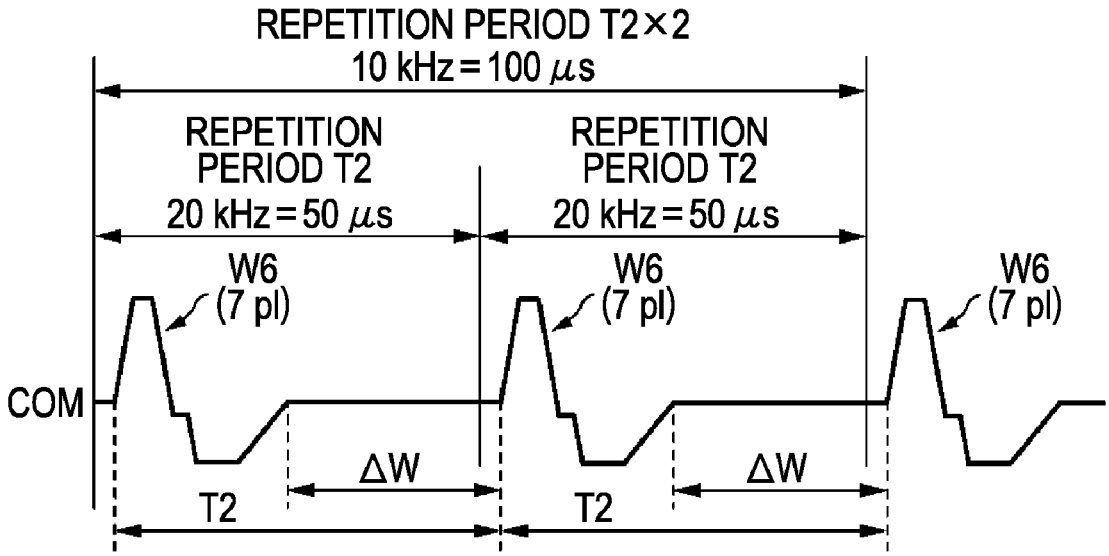
FIG. 10A is a diagram illustrating the driving signal used to acquire the measurement result of FIG. 8.
Figure 10B:
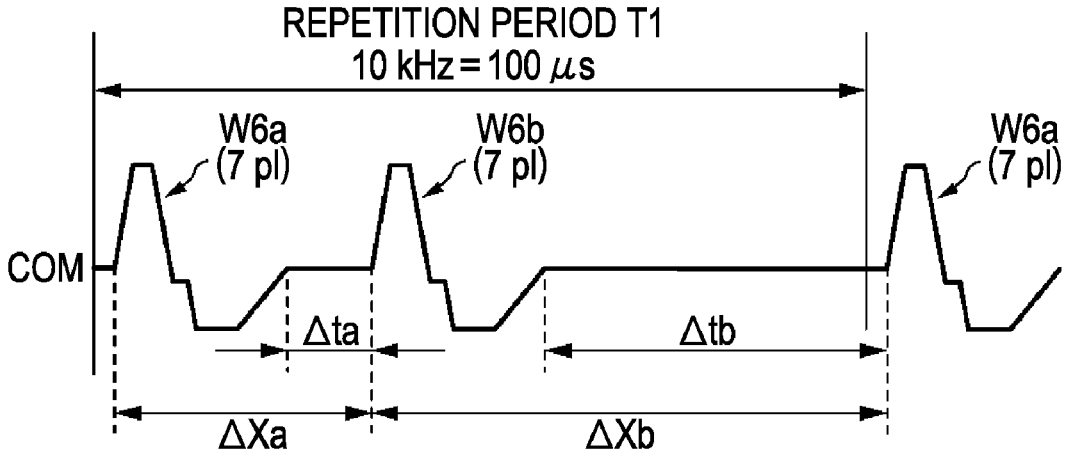
FIG. 10B is a diagram illustrating the driving signal used to acquire the measurement result of FIG. 9.

FIG. 9 is a diagram illustrating a measurement result of an ejection amount of ink when a generation interval Δt of two amount decreasing waveforms is varied a plural number of times in the repetition period T. FIG. 10A is a diagram illustrating the driving signal COM used to acquire the measurement result of FIG. 8. FIG. 10B is a diagram illustrating the driving signal COM used to acquire the measurement result of FIG. 9.

In the driving signal COM used to acquire the measurement result of FIG. 8, as described above, one amount decreasing waveform W6 is generated in a repetition period T2, as shown in FIG. 10A. Therefore, a generation interval (=the repetition period T2) of the successively generated amount decreasing waveforms W6 is constant. Moreover, a waveform interval ΔW is constant between the end point of the variation in the potential of the amount decreasing waveform W6 in the previous repetition period T2 and the start point of the variation in the potential of the amount decreasing waveform W6 in the next repetition period T2.

When one amount decreasing waveform W6 is generated successively at 20 kHz for the driving signal COM (see FIG. 10A) (when two amount decreasing waveforms W6 are generated for a period of 100 μs), the measurement result of FIG. 8 shows that the ink of "18 pl (=9 pl×2)" is ejected from the nozzle by the two amount decreasing waveforms W6. In this way, when two amount decreasing waveforms W6 are generated at a uniform generation period, the ink of 18 pl more than 14 pl, which is a desired amount of ink, is ejected at a high frequency area. In the dot of 18 pl, the variation in the amount of ink is larger, compared to the dot of 10 pl, and the granularity of the print image is not improved.

In the driving signal used to acquire the measurement result of FIG. 9, two amount decreasing waveforms W6 are generated in the repetition period T1, as shown in FIG. 10B. In order to distinguish the two amount decreasing waveforms W6 in the repetition period T1 from each other, the first generated amount decreasing waveform W6 is referred to as "a previous amount decreasing waveform W6*a*" and the subsequently generated amount decreasing waveform W6 is referred to as "a subsequent amount decreasing waveform W6*b*". In the driving signal COM shown in FIG. 10B, the interval of the successively generated amount decreasing waveforms W6 is not constant, but the interval of the two amount decreasing waveforms W6 in the repetition period T1 is relatively short.

Specifically, a generation interval ΔXa (which is a time from the start time point of the variation in the potential of the previous amount decreasing waveform W6*a* to the start time point of the variation in the potential of the subsequent amount decreasing waveform W6*b* and is also referred to as "a generation interval ΔXa in a period" below) between the previous amount decreasing waveform W6*a* and the subsequent amount decreasing waveform W6*b* is shorter than a generation interval ΔXb (which is also referred to as a generation interval ΔXb outside a period below) between the subsequent amount decreasing waveform W6*b* and the previous amount decreasing waveform W6*a* in the next repetition period T1.

Therefore, a waveform interval Δta (which is a time from the end time point of the variation in the potential of the previous amount decreasing waveform W6*a* to the start time point of the variation in the potential of the subsequent amount decreasing waveform W6*b* and is also referred to as "a waveform interval Δta in a period" below) of the previous amount decreasing waveform W6*a* and the subsequent amount decreasing waveform W6*b* is shorter than a waveform interval Δtb (which is also referred to as a waveform interval Δtb outside a period below) of the subsequent amount decreasing waveform W6*b* and the previous amount decreasing waveform W6*a* in the next repetition period.

The measurement result of FIG. 9 is a measurement result obtained by measuring the amount of ink ejected from the nozzle by fixing the repetition period T1 of the driving signal COM shown in FIG. 10B to 100 μs and varying the waveform interval Δta in the period a plural number of times. That is, the measurement result is obtained by generating the two amount decreasing waveforms W6*a* and W6*b* at 10 kHz. In FIG. 9, the horizontal axis represents the waveform interval Δta (μs) in the period and the vertical axis represents the ejection amount of ink (pl).

The measurement result of FIG. 9 is the measurement result obtained by measuring the amount of ink ejected by the two amount decreasing waveforms W6*a* and W6*b* in the repetition period T1 subsequent to the second period for the driving signal COM configured to the two amount decreasing waveforms W6*a* and W6*b* repeatedly in each repetition period T1. Due to the fixed repetition period T1, the waveform interval Δtb outside the period becomes shorter, as the waveform interval Δta in the period is longer.

In the measurement result of FIG. 9, the ejection amount of ink is varied and the ejection amount of ink also increases, as the waveform interval Δta in the period is longer. Specifically, in FIG. 9, when the waveform interval Δta in the period is 2 μs at minimum, the amount of ink ejected by the two amount decreasing waveforms W6*a* and W6*b* is 12 pl. When the waveform interval Δta in the period is 15 μs at maximum, the amount of ink ejected by the two amount decreasing waveforms W6*a* and W6*b* is 15 pl. Therefore, in the measurement result of FIG. 9, there is a point where the desired amount of ink ejected by the two amount decreasing waveforms W6*a* and W6*b* is "14 pl". Specifically, when the waveform interval Δta of the two amount decreasing waveforms is Δta(1), Δta (2), and Δta(3) in FIG. 9, the amount of ink of 14 pl is ejected from the nozzle. From the measurement result of FIG. 9, it can be known that the desired amount of ink (14 pl) can be ejected by adjusting the waveform interval Δta of the amount decreasing waveform W.

In summary, when the driving signal COM having the amount decreasing waveforms W6 generated at the uniform waveform interval (ΔW) is used, as in FIG. 10A, upon generating the two amount decreasing waveforms W6 in the high frequency area (for example, 10 kHz) (upon generating the two amount decreasing waveforms W6 for 100 μs), the ink of 18 pl larger than the desired ink of 14 pl may be ejected (see FIG. 8). However, when the waveform interval Δta in the repetition period T is made shorter than the waveform interval Δtb outside the repetition period T by varying the waveform intervals (Δta and Δtb) of the amount decreasing waveform W6, as in FIG. 10B, the desired ink of 14 pl can be ejected.

In this embodiment, in order to eject the ink of "14 pl (corresponding to the amount of liquid which is the double of another amount of liquid)", which is the amount of ink between the amount of ink of "10 pl" ejected by one basic waveform W1 and the amount of ink of "20 pl" ejected by two basic waveforms W1, by using the nozzle ejecting the ink of 10 pl (corresponding to the maximum amount of liquid) by the basic waveform W1 (corresponding to a first driving waveform), the driving signal COM is used in which two amount decreasing waveforms W6 configured to eject the amount of ink of "7 pl (corresponding to another amount of liquid)" smaller than the amount of ink ejected by the basic waveform W1 are generated in the repetition period T. That is, the driving signal COM is used in which the waveform interval Δta of the amount decreasing waveform W6 is adjusted in the repetition period T so that the ink of 14 pl is ejected in the high frequency area. In this way, the granularity can be improved, compared to the driving signal COM (see FIG. 5) according to the comparative example.

Driving Signal COM According to Embodiment

Figure 11:
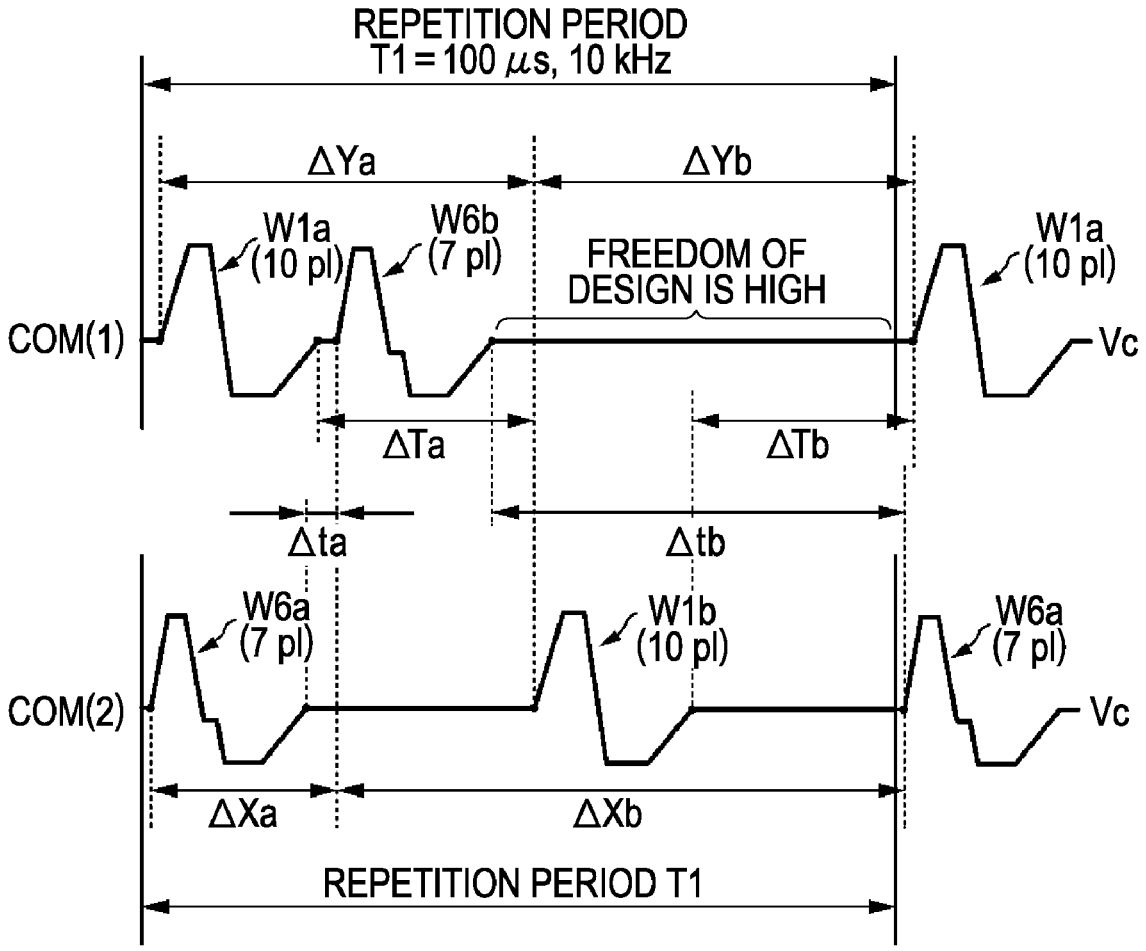
FIG. 11 is a diagram illustrating a part of the driving waveform of the driving signal according to the embodiment.

FIG. 11 is a diagram illustrating a part of the driving waveform of the driving signal COM according to the embodiment. In the driving signal COM according to this embodiment, two driving signals COM(1) and COM(2) can be applied to one driving element, as in the driving signal COM according to the comparative example. In FIG. 11, for simple description, only two basic waveforms (first waveforms W1) configured to eject the ink of 10 pl and two amount decreasing waveforms (sixth waveforms W6) configured to eject the ink of 7 pl are shown as the driving waveforms generated in the repetition period T1. In the first driving signal COM(1) shown in FIG. 11, the basic waveform W1 is first generated, and then the amount decreasing waveform W6 is generated. On the other hand, in the second driving signal COM(2), the amount decreasing waveform W6 is generated, and then the basic waveform W1 is generated.

As described above, a generation interval (a generation interval in a period) of the previous amount decreasing waveform W6*a* and the subsequent amount decreasing waveform W6*b* is referred to as "ΔXa". A generation interval (a generation interval outside a period) of the subsequent amount decreasing waveform W6*b* and the previous amount decreasing waveform W6*a* of the next repetition period T1 is referred to as "ΔXb". In addition, a waveform interval (a waveform interval in a period) of the previous amount decreasing waveform W6*a* and the subsequent amount decreasing waveform W6*b* is referred to as "Δta". A waveform interval (a waveform interval outside a period) of the subsequent amount decreasing waveform W6*b* and the previous amount decreasing waveform W6*a* of the next repetition period T1 is referred to as "Δtb".

The basic waveform W1 generated first in the repetition period T1 is referred to as "a previous basic waveform W1*a*". The basic waveform W1 generated subsequently in the repetition period T is referred to as "a subsequent basic waveform W1*b*". In addition, a generation interval of the previous basic waveform W1*a* and the subsequent basic waveform W1*b* is referred to as "ΔYa". A generation interval of the subsequent basic waveform W1*b* and the previous basic period W1*a* of the next repetition period T1 is referred to as "ΔYb". In addition, a waveform interval of the previous basic waveform W1*a* and the subsequent basic waveform W1*b* is referred to as "ΔTa". A waveform interval of the subsequent basic waveform W1*b* and the previous basic waveform W1*a* of the next repetition period T1 is referred to as "ΔTb".

In the driving signal COM according to this embodiment, the generation interval "ΔXa" of the amount decreasing waveform W6 in the repetition period T1 is shorter than the generation interval "ΔYa" of the basic waveform W1 in the repetition period T1. The waveform interval "Δta" of the amount decreasing waveform W6 in the repetition period T1 is shorter than the waveform interval "ΔTa" of the basis waveform W1 in the repetition period T1.

It is assumed that the generation interval ΔYa of the basic waveform W1 in the repetition period T1 is the same as the half period of the repetition period T1 (where ΔYa=T1/2). Therefore, the generation interval ΔYb of the basic waveform W1 in the repetition period T1 is also the same as the half period of the repetition period T1 (where ΔYb=T1/2). It is preferable that the generation interval ΔYa of the basic waveform W1 in the repetition period T1 is set to the half period (T1/2) of the repetition period T1 or to a value close to the half period. The reason is described below.

As described above, since the waveform shape of the basic waveform W1 is not more complex than that of the other driving waveforms such as the amount decreasing waveform W6, the residual vibration of the meniscus after the ink ejection by the basic waveform W1 is suppressed easily. Accordingly, two first waveforms W1 can be generated in the repetition period T. In other words, in the basic waveforms W1, a desired amount of ink (20 pl) is ejected by relatively stabilizing the residual vibration of the meniscus after the ink ejection by the basic waveform W1 in the repetition period T, and then applying the subsequent basic waveform W1 to the piezoelectric element.

In order to stabilize the state of the meniscus after the ink ejection by the basic waveforms W1 applied successively to the piezoelectric element, both the generation interval ΔYa of the basic waveform W1 in the repetition period T1 and the generation interval ΔYb of the basic waveform W1 outside the repetition period T1 may be made as long as possible. On the contrary, in order to shorten the print time, the repetition period T1 may be shortened. Here, the generation interval ΔYa of the basic waveform W1 in the repetition period T1 and the generation interval ΔYb of the basic waveform W1 outside the repetition period T1 may be set to the half period (T1/2) of the repetition period T1 or may be set to a value close to the half period. In this way, even when the basic waveforms W1 in the same repetition period T1 are applied successively to the piezoelectric element, or even when the basic waveforms W1 in the different repetition periods T1 are applied successively to the piezoelectric element, the state of the meniscus after the ink ejection by the basic waveforms W1 can be stabilized. Moreover, the repetition period T1 can be made as small as possible.

By setting the generation intervals ΔYa and ΔYb of the two basic waveforms W1*a* and W1*b* to the half period (T1/2) of the repetition period T1 or a value close to the half period, the basic waveform W1 is generated in each of the first half and the second half of the repetition period T1. In this way, by arranging the two basic waveforms W1 in the repetition period T1 in a good balanced manner, two dots formed by the basic waveforms W1 can be arranged uniformly in a pixel. In particular, since the dots formed by the basic waveforms W1 are dots formed with the maximum amount of ink ejected from the nozzle once, the image quality can be further improved by arranging the dots uniformly in a pixel.

On the other hand, in the amount decreasing waveform W6, it is more difficult to suppress the residual vibration of the meniscus after the ink ejection, compared to the basic waveform W1. However, in the driving signal COM according to this embodiment, the generation interval ΔXa of the amount decreasing waveform W6 in the repetition period T1 is shorter than the generation interval ΔYa of the basic waveform W1. For this reason, in the amount decreasing waveform W6, the subsequent amount decreasing waveform W6 is applied to the piezoelectric element in the state where the residual vibration of the meniscus after the ink ejection by the previous amount decreasing waveform W6*a* in the repetition period T is not stable.

From the measurement result of FIG. 9, however, it can be known that the desired amount of ink can be ejected by adjusting the application time of the subsequent amount decreasing waveform W6*b* even in the state where the meniscus after the ink ejection by the previous amount decreasing waveform W6*a* is not stable. Moreover, from the measurement result of FIG. 9, it can be known that when the waveform interval Δta of the previous amount decreasing waveform W6*a* and the amount decreasing waveform W6*b* is short (for example, 2 μs in FIG. 9), the amount of ink smaller than the desired amount of ink (14 pl) is ejected. Moreover, it can be known that as the waveform interval Δta is longer (for example, 15 μs in FIG. 9), the amount of ink larger than the desired amount of ink (14 pl) is ejected. For this reason, in the driving signal COM (see FIG. 11), the desired amount of ink (14 pl) can be ejected by setting the waveform interval Δta (the generation interval ΔXa) of the previous amount decreasing waveform W6*a* and the subsequent amount decreasing waveform W6*b* in the repetition period T to be relatively short and by setting the waveform interval Δtb (the generation interval ΔXb) of the previous basic waveform W1*a* and the subsequent basic waveform W1*b* in the repetition period T to be shorter.

Specifically, when the length of the repetition period T1 is first set to 100 μs so that the generation intervals ΔYa and ΔYb of the two basic waveforms W1*a* and W1*b* are the same as the half period (T1/2) of the repetition period T1, the generation interval ΔYa of the basic waveform W1 in the repetition period T becomes "50 μs". Accordingly, in order to eject the ink of 14 pl from the nozzle by the two amount decreasing waveforms W6, the waveform interval Δta in the repetition period T1 may be set to one of "Δta(1), Δta(2), and Δta(3)" in the measurement result of FIG. 9. When the potential variation time (see FIG. 6B) of the amount decreasing waveform is set to 15 μs and the waveform interval Δta is set to the maximum Δta(3) (=about 9.5 μs), the generation interval ΔXa of the amount decreasing waveform W6 in the repetition period T becomes "24.5 μs".

In this way, in the driving signal COM according to this embodiment, the generation interval ΔXa (=24.5 μs) of the amount decreasing waveform W6 in the repetition period T1 is shorter than the generation interval ΔYa (=50 μs) of the amount decreasing waveform W1 in the repetition period T1. The temporal interval ΔYa (=50 μs, which corresponds to a temporal interval at which the first driving waveform is generated) at which the basic waveform W1 is generated in the repetition period T1 is closer to the half length (=50 μs) of the repetition period T1 than the temporal interval ΔXa (=24.5 μs, which corresponds to the temporal interval at which the second driving waveform is generated) at which the amount decreasing waveform W6 is generated.

That is, as for the basic waveform W1, the subsequent basic waveform W1*b* is generated, after the state of the meniscus after the ink ejection by the previous basic waveform W1*a* becomes relatively stable. Therefore, it is necessary to set the generation interval ΔYa (the waveform interval Δta) of the basic waveform W1 in the repetition period T1 to be relatively long. As for the amount decreasing waveform W6, however, the subsequent amount decreasing waveform W6*b* is generated at time (Δta(1) to Δta(3) in FIG. 9), at which the meniscus is formed so that the desired amount of ink is ejected, during an increase in the amount of ink ejected from the nozzle, before the meniscus after the ink ejection by the previous amount decreasing waveform W6*a* is stable. For this reason, in the driving signal COM according to this embodiment, the generation interval ΔYa of the two basic waveforms W1 in the repetition period T1 is set to a value closer to the half period (T1/2) of the repetition period T1 than the generation interval ΔXa of the two amount decreasing waveforms W6 in the repetition period T1.

In a printer using the driving signal COM of which the variation in the dot size is larger, as in the driving signal COM (see FIG. 5) according to the comparative example, than the driving signal COM according to this embodiment, light ink such as light cyan or light magenta may be used in addition to ink of four colors (for example, yellow, magenta, cyan, and black) to improve the granularity of the print image. However, in a printer using the driving signal COM according to this embodiment, the variation in the dot size can be made small. Therefore, the granularity can be improved without using the color ink other than the ink of four colors.

Even when the amount decreasing waveforms W6, in which the meniscus after the ink ejection rarely becomes stable, are applied successively to the piezoelectric element at the high frequency area, as in the driving signal COM according to this embodiment, the driving signal COM configured to eject the desired amount of ink may be used. Then, since it is not necessary to provide a nozzle with a size smaller than that of the 10 pl nozzle in order to eject ink of 7 pl, except for the 10 pl nozzle ejecting the ink of 10 pl by the basic waveform W1 in which the meniscus after the ejection of ink becomes stable easily, the granularity of the print image can be improved. Accordingly, the apparatus can be simplified and the low cost can be realized.

FIG. 12 is a diagram illustrating a relationship between the driving signal COM according to this embodiment and the selection data q. The driving signal COM shown in FIG. 12 is the driving signal COM in which a driving waveform W is generated other than the basic waveform W1 and the amount decreasing waveform W6 for the maintenance period of the middle potential Vc in the driving signal COM shown in FIG. 11. Accordingly, as in the driving signal COM shown in FIG. 11, in the driving signal COM shown in FIG. 12, the generation intervals ΔXa (the waveform intervals Δta) of the two amount decreasing waveforms are also set to be relatively short so as to eject the desired ink of 14 pl by the two amount decreasing waveforms W6*a* and W6*b*. In addition, the interval of the generation intervals ΔYa of the two basic waveforms W1 is set to the half period of the repetition period T1, and the two basic waveforms W1 are arranged in a balanced manner in the repetition period T1. As a consequence, the generation interval ΔYa of the two basic waveforms W1 in the repetition period T1 is closer to the half period (T1/2) of the repetition period T1 than the generation interval ΔXa of the two amount decreasing waveforms in the repetition period T1.

In this embodiment, two driving signals COM(1) and COM(2) can be applied to one driving element. Dots of seven sizes are formed for one pixel and one pixel can be expressed by eight gray scales. The dots of seven sizes include a first dot (1 pl), a second dot (1.6 pl), a third dot (2.5 pl), a fourth dot (7 pl), a fifth dot (10 pl), a sixth dot (14 pl), and a seventh dot (20 pl) in order of the smaller dot.

In the first driving signal COM(1), "the first basic waveform W1*a*" configured to eject the ink of 10 pl is generated for a time T11 of the repetition period T1. "The subsequent amount decreasing waveform W6*b*" configured to eject the ink of 7 pl is generated for a time T12. "A third waveform W3" configured to eject ink of 1.6 pl is generated for a time T13. "A seventh waveform W7" configured to eject ink of 1.0 pl is generated for a time T14.

On the other hand, in the second driving signal COM(2), "the previous amount decreasing waveform W6*a*" configured to eject the ink of 7 pl is generated for a time T15 of the repetition period T1. "A second waveform W2" configured to eject ink of 2.5 pl is generated for a time T16. "The subsequent basic waveform W1*b*" configured to eject the ink of 10 pl is generated for a time T17. A fifth waveform W5 configured for minute vibration is generated for a time T18.

Since the repetition period T1 of the first driving signal COM(1) is divided into four periods, the corresponding selection signals q0 to q7 can be expressed by 4-bit data. In addition, since the repetition period T1 of the second driving signal COM(2) is divided into four periods, the corresponding selection signals q8 to q15 can be expressed by 4-bit data.

When the dot formation data SI indicate "no dot", the selection data q0 for the first driving signal COM(1) is represented by "0000" and the selection data q8 for the second driving signal COM(2) is represented by "0001". Then, the fifth waveform W5 configured for the minute vibration is applied. Likewise, when the dot formation data SI indicates "first dot formation (1 pl)", the selection data q1 is represented by "0001" and the selection data q9 is represented by "0000". Then, the seventh waveform W7 is applied. When the dot formation data SI indicates "second dot formation (1.6 pl)", the selection data q2 is represented by "0010" and the selection data q10 is represented by "0000". Then, the third waveform W3 is applied. When the dot formation data SI indicates "third dot formation (2.5 pl)", the selection data q3 is represented by "0000" and the selection data q11 is represented by "0100". Then, the second waveform W2 is applied.

When the dot formation data SI indicates "fourth dot formation (7 pl)", the selection data q4 is represented by "0000" and the selection data q12 is represented by "1000". Then, the previous amount decreasing waveform W6*a* is applied. When the dot formation data SI indicates "fifth dot formation (10 pl)", the selection data q5 is represented by "0000" and the selection data q13 is represented by "0010". Then, the subsequent basic waveform W1*b* is applied. When the dot formation data SI indicates "sixth dot formation (14 pl)", the selection data q6 is represented by "0100" and the selection data q14 is represented by "1000". Then, the previous amount decreasing waveform W6*a* and the subsequent amount decreasing waveform W6*b* are applied. When the dot formation data SI indicates "seventh dot formation (20 pl)", the selection data q7 is represented by "1000" and the selection data q15 is represented by "0010". Then, the previous basic waveform W1*a* and the subsequent basic waveform W1*b* are applied.

According to the driving signal COM, it is possible to form the dot of 14 pl, which is the amount of ink between the 10 pl and 20 pl and is close to the average value (15 p1) of 10 pl and 20 pl. As a consequence, as shown in FIG. 12, the variation in the amount of ink upon varying the dot size from the smaller dot to the larger dot can be made smaller, compared to the driving signal COM according to the comparative example. The amount of ink ejected from the nozzle by the two amount decreasing waveforms is not limited to "14 pl". For example, the ink of 16 pl may be ejected from the nozzle by the two amount decreasing waveforms by ejecting ink of 8 pl from the nozzle one amount decreasing waveform.

In the driving signal COM according to this embodiment, the two amount decreasing waveforms W6*a* and W6*b* in the repetition period T1 are generated in the first half of the repetition period T1. Accordingly, when the head 41 is moved in the moving direction from the left side to the right side, for example, the dots formed by the two amount decreasing waveforms W6 may be deviated from the pixel to the left side. However, a dot (a dot of 10 pl) formed by the basic waveform W1 is larger than a dot (a dot of 7 pl) formed by the amount decreasing waveform W6. Accordingly, even when two dots formed by the amount decreasing waveforms W6 are deviated from the pixel to one side, the two dots by the amount decreasing waveforms W6 are not less recognized on an image in comparison to the case where two dots formed by the basic waveforms W1 are deviated from the pixel to one side.

In the driving signal COM according to this embodiment, the driving waveforms which are likely to be applied to the piezoelectric element in the same repetition period T are dividedly formed in the first driving signal COM(1) and the second driving signal COM(2). That is, the two basic waveforms W1 are generated in the first driving signal COM(1) and the second driving signal COM(2), respectively. The two amount decreasing waveforms W6 are generated in the first driving signal COM(1) and the second driving signal COM (2), respectively. In this way, the amount of heat generated in the driving signal generating circuit 15 upon applying the driving waveforms W to the piezoelectric element can be dispersed to the driving signal generating circuit 15 generating the first driving signal COM(1) and the driving signal generating circuit 15 generating the second driving signal COM(2). For example, when solid printing is performed, the seventh dot (the dot of 20 pl) with the maximum size is used numerously. For this reason, when the two basic waveforms W1 are generated in one driving signal COM, the amount of heat generated by the driving signal generating circuit 15 generating the one driving signal COM become larger, thereby causing the breakdown.

When the dot of 7 pl (a fourth dot) is formed by one amount decreasing waveform W6, the previous amount decreasing waveform W6*a* generated for the time T15 is used of the two amount decreasing waveforms W6 in the repetition period T1. By doing so, it is possible to ensure the relatively long time from the application end of the previous amount decreasing waveform W6 to the application of the driving waveform in the next repetition period T1. Accordingly, even in the previous amount decreasing waveform W6*a* in which the meniscus after the ink ejection is rarely suppressed, the meniscus can be stabilized until the driving waveform of the next repetition period T1 is applied. As a consequence, a more exact amount of ink can be ejected.

Driving Signal COM According to Modified Example

Figure 13A:
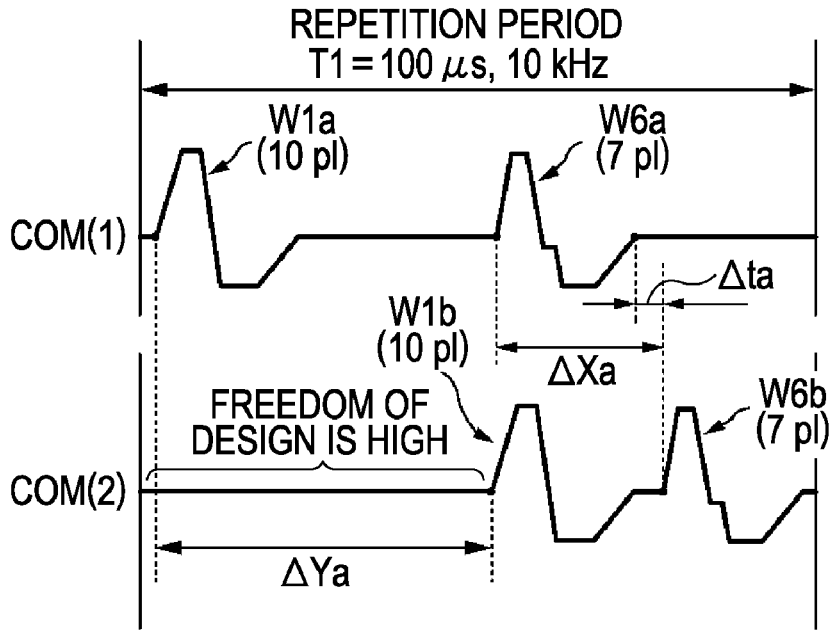
FIGS. 13A and 13B are diagrams illustrating different arrangement of two amount decreasing waveforms.
Figure 13B:
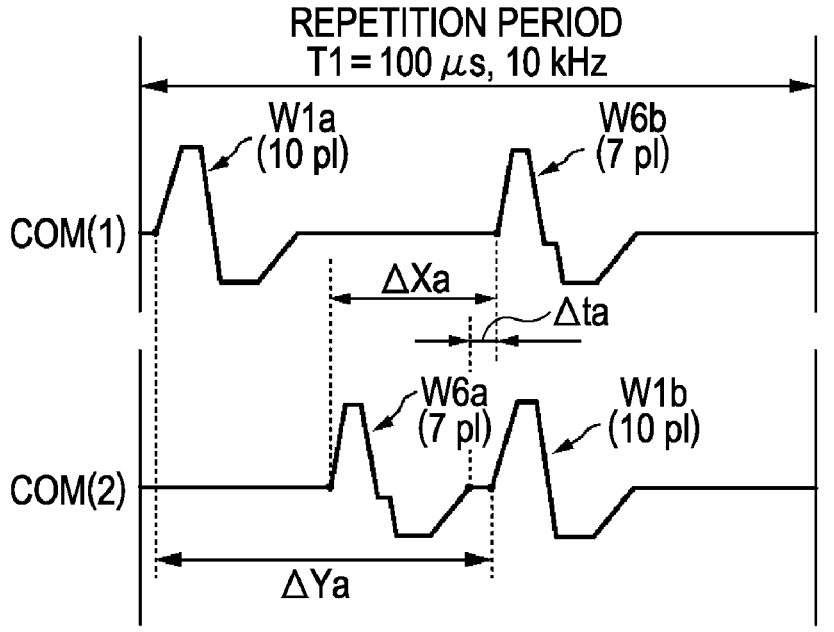

FIG. 13A is a diagram illustrating the two amount decreasing waveforms W6*a* and W6*b* formed in the second half of the repetition period T. FIG. 13B is a diagram illustrating the two amount decreasing waveforms W6*a* and W6*b* formed in the middle of the repetition period T. In the driving signal COM shown in FIGS. 11 and 12, the two amount decreasing waveforms W6*a* and W6*b* are formed in the first half (the time T15 and the time T12 in FIG. 12) of the repetition period T.

In the driving signal COM according to this embodiment, the generation interval ΔXa of the amount decreasing waveform W6 is shorter than the generation interval ΔYa of the basic waveform W1, as shown in FIG. 11. Therefore, the two amount decreasing waveforms W6 in the repetition period T are generated successively. On the other hand, the basic waveforms W1 are generated in the first half and the second half of the repetition period T, respectively.

When the two amount decreasing waveforms W6 are generated in the first half of the repetition period T, as in FIG. 11, the maintenance period of the middle potential Vc becomes longer for the driving signal (COM(1)) in which the basic waveform W1*b* is not generated during the second half of the repetition period T. For the maintenance period of the middle potential Vc, another driving waveform W (for example, the third waveform W3) other than the amount decreasing waveform W6 and the basic waveform W1 may be generated. Accordingly, the freedom of design of another driving waveform becomes higher, as the maintenance period of the middle potential Vc is longer.

When the two amount decreasing waveforms W6 are generated in the second half of the repetition period T, as in FIG. 13A, the maintenance period of the middle potential Vc becomes longer for the driving signal (COM(2)) in which the basic waveform W1*a* is not generated for the first half of the repetition period. Accordingly, the freedom of design of another driving waveform W is improved, since the maintenance period of the middle potential Vc is longer.

That is, in the driving signal COM according to this embodiment, the generation interval ΔXa of the two amount decreasing waveforms W6 is set short to eject the desired amount of ink in the repetition period T. Accordingly, by generating the two amount decreasing waveforms W6 in one of the first half and the second half of the repetition period T, the freedom of design of another driving waveform W can be improved.

However, the invention is not limited thereto. For example, when the ink of 14 pl is ejected by adjusting the generation interval ΔXa of the two amount decreasing waveforms W6, as in FIG. 13B, the two amount decreasing waveforms W6 may be generated in the middle of the repetition period T. In this case, since the time at which the maintenance period of the middle potential Vc is long, the freedom of design of another driving signal W may be lowered, compared to the driving signal COM in FIG. 11 or 13A. However, since the dots (the dot of 7 pl and the dot of 14 pl) formed by the amount decreasing waveforms W6 can be formed in the relative middle portion of the pixel, the image quality can be improved.

Figure 14A:
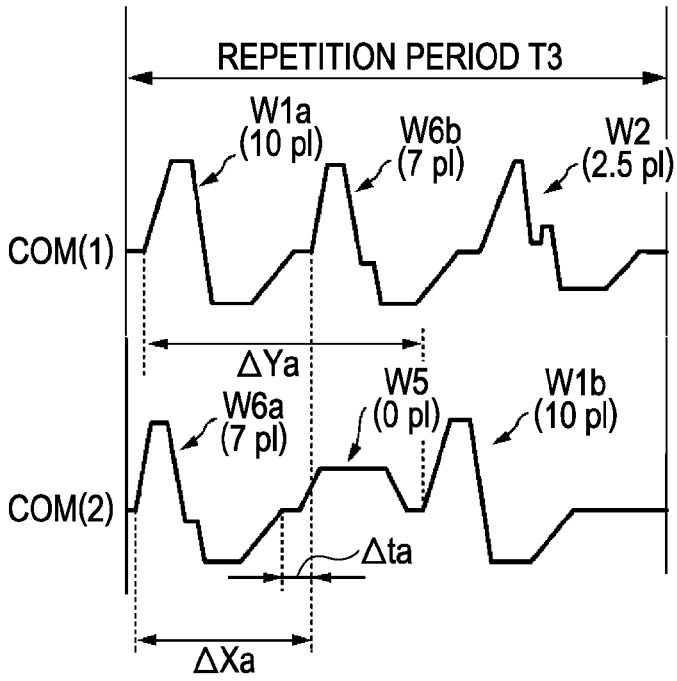
FIGS. 14A and 14B are diagrams illustrating driving signals according to modified examples.

FIG. 14A is a diagram illustrating the driving signal COM configured to form smaller kinds of dots. In the driving signal COM described above with reference to FIG. 12, the seven kinds of dots are formed for one pixel and one pixel can be expressed by the eight gray scales. However, the invention is not limited thereto. The kinds of dots can be reduced. For example, in the driving signal COM shown in FIG. 14A, the dot of 10 pl and the dot of 20 pl are formed by the two basic waveforms W1, the dot of 7 pl and the dot of 14 pl are formed by the two basic waveforms W6, and the dot of 2.5 pl is formed by the second waveform W2. That is, five kinds of dots are formed and one pixel is expressed by six gray scales. According to the driving signal COM, the dots with the sizes between the dot of 10 pl and the dot of 20 pl can be formed. Therefore, the granularity of the print image can be improved, compared to the driving signal COM (see FIG. 5) according to the comparative example.

In such a driving signal COM, the generation interval ΔXa of the amount decreasing waveform W6 in the repetition period T3 may be set so that the desired amount of ink (14 pl) is ejected. The generation interval of the two basic waveforms W1 in the repetition period T3 may be set to the half length (T/2) of the repetition period T3 or a value close to the half length. In this way, the large dot of 10 pl may be formed in the pixel in a balanced manner.

The measurement result of FIG. 9 is a measurement result of the ejection amount of ink when the waveform interval Δta of the two amount decreasing waveform W6 generated in the repetition period T1 of 100 μs. When the length of the repetition period T is different, the waveform interval Δta at which the desired amount of ink is ejected is also different. In the driving signal COM shown in FIG. 14A, the number of driving waveforms is smaller than that of driving waveforms in the driving waveforms COM shown in FIG. 12 and the length of the repetition period T3 becomes shorter. Therefore, in the waveform interval Δta of the amount decreasing waveform W6, the driving signal COM shown in FIG. 14A is different from the driving signal COM shown in FIG. 12.

According to a modified example of the driving signal COM, the driving signal COM (not shown) in which the two basic waveforms W1, the two amount decreasing waveforms W6, and the waveform W5 for the minute vibration may be used. In this case, since four kinds of dots (the dot of 7 pl, the dot of 10 pl, the dot of 14 pl, and the dot of 20 pl) can be formed, one pixel can be expressed by five gray scales. Even when the dot with the tiny size is not formed and the relatively large dot is formed in a narrow range, the granularity of the print image can be improved by making the increase degree of the ink from the smaller dot to the larger dot as small as possible.

Figure 14B:
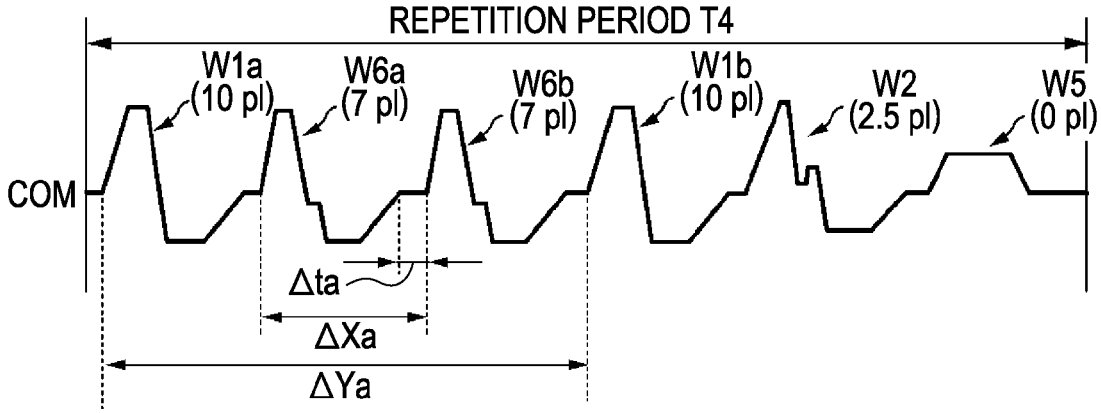

FIG. 14B is a diagram illustrating one driving signal COM applicable to the piezoelectric element. When the number of driving signals is reduced by reducing the kinds of dots in comparison to the above-described driving signal COM (see FIG. 12), just one driving signal COM applicable to the piezoelectric element may be used. In this way, when one driving signal generating circuit 15 is provided for one nozzle row, the circuit can be simplified.

In such a driving signal COM, the generation interval ΔXa of the amount decreasing waveform W6 may be set so that the desired amount of ink (14 pl) is ejected. In addition, the generation interval ΔYa of the basic waveforms W1 may be set to the half period of the repetition period T4 or a value close to the half period. Accordingly, as shown in FIG. 14B, for example, in the repetition period T4, the basic waveform W1 may be first generated, two amount decreasing waveforms W6 may be generated, and then the basic waveform W1 may be generated.

Process of Designing Driving Signal COM

Figure 15:
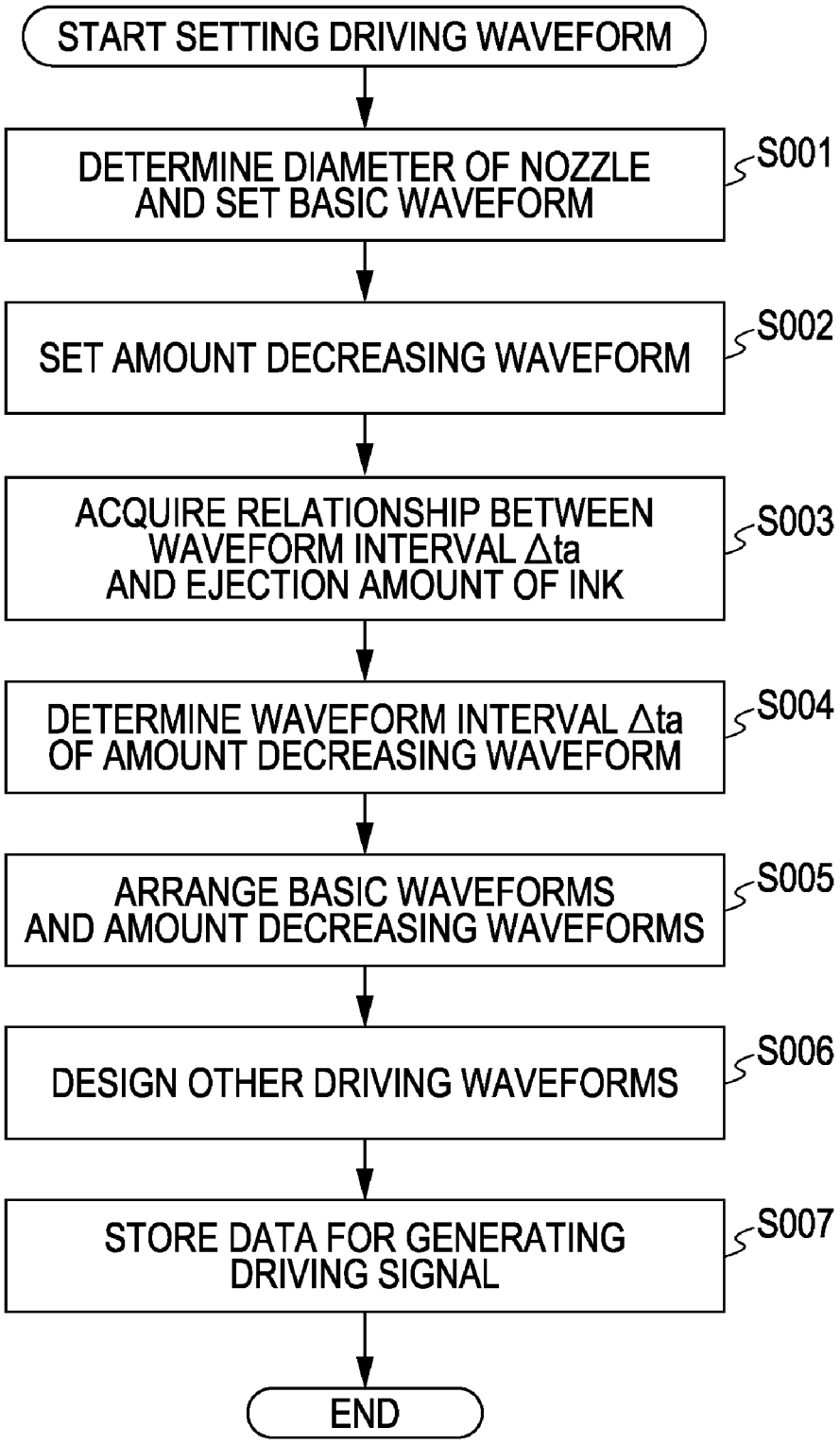
FIG. 15 is a diagram illustrating a method of designing the driving waveform in the driving signal.

FIG. 15 is a diagram illustrating a method of designing the driving waveforms W of the driving signal COM. Hereinafter, the method of designing the driving signals COM described with reference to FIG. 12 to FIGS. 14A and 14B will be described. In a process of designing the printer 1, the driving signal COM used by the printer 1 is designed. In this case, the maximum amount of ink ejected from the nozzle once is first determined. For example, in the case of the driving signal COM shown in FIG. 12, the maximum amount of ink ejected from the nozzle once is "10 pl". Then, the diameter of the nozzle and the basic waveform (a parameter such as Vh) are determined so as to eject the maximum amount of ink (10 pl) ejected from the nozzle once by the driving waveform, in which the meniscus after the ejection of an ink droplet is easily stable even in the high frequency area, like the basic waveform W1 in FIG. 6A (S001). By providing two basic waveforms in the repetition period T and ejecting the amount of ink (20 pl), which is a double of the amount of ink ejected from the nozzle once in the repetition period T, the maximum dot is formed among the dots formed in one pixel.

Subsequently, in order to improve the granularity, the driving waveform is designed to eject the amount of ink between 10 pl and 20 pl. Since the maximum amount of ink ejected from the nozzle once is 10 pl, the amount of ink between 10 pl and 20 pl is ejected by two driving waveforms. For example, when the ink of 14 pl between 10 pl and 20 pl is ejected, as in the driving signal COM shown in FIG. 12, the amount decreasing waveform configured to eject the ink of 7 pl from the nozzle once is designed (S002). That is, the amount decreasing waveform (for example, see FIG. 6B) is designed so as to eject the ink of 7 pl smaller than 10 pl from the nozzle ejecting the ink 10 pl by the basic waveform (for example, see FIG. 6A) in which the meniscus after the ink ejection becomes stable easily.

In the amount decreasing waveform formed by modifying the basic waveform in which the meniscus after the ink ejection becomes stable easily, the angle at increase time of the potential may be large or the shape of the amount decreasing waveform may be complex. For this reason, it is difficult to stabilize the meniscus after the ink ejection. Accordingly, when two amount decreasing waveforms are generated the short repetition period T (when the amount decreasing waveforms are used at the high frequency area), it is necessary to adjust the generation interval Δta (the generation interval ΔXa) of the two amount decreasing waveform so that the desired amount of ink (14 pl) is ejected. As in FIG. 9, the waveform interval Δta of the two amount decreasing waveforms, that is, the generation interval ΔXa (corresponding to the temporal interval at which the second driving waveform is generated) of the two amount decreasing waveforms is varied a plural number of times, so that the result obtained by measuring the amount of ink ejected from the nozzle is obtained. The basic waveform W1 and the amount decreasing waveform W6 are designed. On the other hand, the length of the repetition period T is also determined. By varying the generation interval Δta of the two amount decreasing waveforms in a predetermined repetition period T (100 μs in FIG. 9) a plural number of times, "the relationship between the waveform interval Δta and the ejection amount of ink" is acquired (S003).

Subsequently, on the basis of the relationship between the waveform interval Δta and the ejection amount of ink, the waveform interval Δta used to calculate the desired ejection amount of ink is acquired. The temporal interval at which the two amount decreasing waveforms are generated is determined for the driving signal COM used in the actual printing. For example, in the relationship between the waveform interval Δta and the ejection amount of ink in FIG. 9, there are three waveform intervals (Δta(1), Δta(2), and Δta(3)) at which the desired amount of ink of 14 pl is ejected. In this way, when there are several candidate waveform intervals Δta of the amount decreasing waveforms, one waveform interval Δta of the driving signal COM used in the actual printing is determined.

As a method of determining the waveform interval Δta among the several candidate waveform intervals, the waveform interval is determined on the basis of the length of the waveform interval Δta. For example, by selecting the waveform interval Δta with a short length (Δta(1) in the measurement result of FIG. 9), it is possible to improve a freedom of design of another driving waveform (other than the basic waveform and the amount decreasing waveform) set in the repetition period T1.

Otherwise, the waveform interval Δta may be determined on the basis of the ejection feature of the ink droplet at each candidate waveform interval Δta. For example, by confirming whether satellites (tiny ink droplets) after the ink droplet ejection at each candidate waveform interval Δta are generated, the waveform interval Δta at which the satellites are rarely generated may be selected. In this way, the image quality can be prevented from deteriorating due to the satellites.

The waveform interval Δta may be determined on the basis of the variation in the ejection amount of ink at each candidate waveform interval Δta. The variation in the ejection amount of ink corresponds to a "slope" of each candidate waveform interval Δta in the result (the measurement result plotted in the graph of FIG. 9) indicating the variation in the ejection amount of ink. Specifically, by calculating the variation in the ejection amount of ink for a predetermined period (Δta±predetermined time (μs)) before and after the candidate waveform interval Δta, the waveform interval Δta with a small variation is selected. Accordingly, even when the waveform interval Δta may be slightly deviated due to an error upon generating the driving signal COM, the amount of ink close to the desired amount of ink is ejected. When the waveform interval Δta of the amount decreasing waveforms is determined, the invention is not limited to the method of considering one of the length, the other ejection features, and the variation in the ejection amount of ink, but the plurality thereof may be considered.

The two basic waveforms and the two amount decreasing waveforms in the repetition period T are arranged after the waveform interval Δta of the amount decreasing waveform is determined (S005). As described above, by setting the generation interval (ΔYa in FIG. 11) of the basic waveforms W1 in the repetition period T to a value close to the half period (T/2) of the repetition period T as much as possible, the basic waveform W1 is generated in each of the first half and the second half of the repetition period T. On the other hand, by generating the two amount decreasing waveforms in the first half or the second half of the repetition period T, as shown in FIG. 11 or 13A, the freedom of design of another driving waveform may be improved. Alternatively, as shown in FIG. 13B, by generating the amount decreasing waveforms in the middle of the repetition period T, the dot may be formed in the middle portion of the pixel.

Subsequently, the driving waveform W is designed to form the dot of a size other than that of the dot formed in the basic waveforms W1 and the amount decreasing waveforms W6 (S006). For example, in the case of the driving signal COM shown in FIG. 12, the driving waveforms (W2, W3, and W7) are designed to eject the amount of ink of "2.5 pl, 1.6 pl, and 1 pl" and the waveform W5 for the minute vibration is designed.

After the driving signal COM used in the printer 1 is designed, data prepared to create the driving signal COM is stored in the memory 13 or the like of the printer 1 (S007). Specifically, since the controller 10 of the printer 1 permits the driving signal generating circuit 15 to generate the driving signal COM in the actual printing, the data (corresponding to the data prepared to create the driving signal such as the DAC value in FIG. 3) output to the driving signal generating circuit 15 is stored in the memory 13. In the printer 1 using the driving signal COM designed in accordance with the flow of FIG. 15, the granularity of an image is improved and the print time is also shortened. The designing sequence of the driving signal COM shown in FIG. 15 is just an example, and the invention is not limited thereto.

MODIFIED EXAMPLES

Figure 16A:
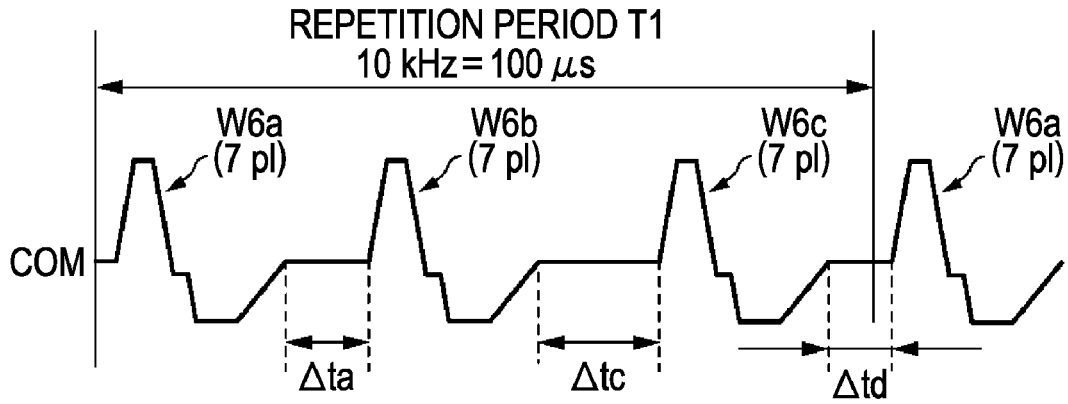
FIGS. 16A and 16B are diagrams illustrating driving signals according to modified examples.
Figure 16B:
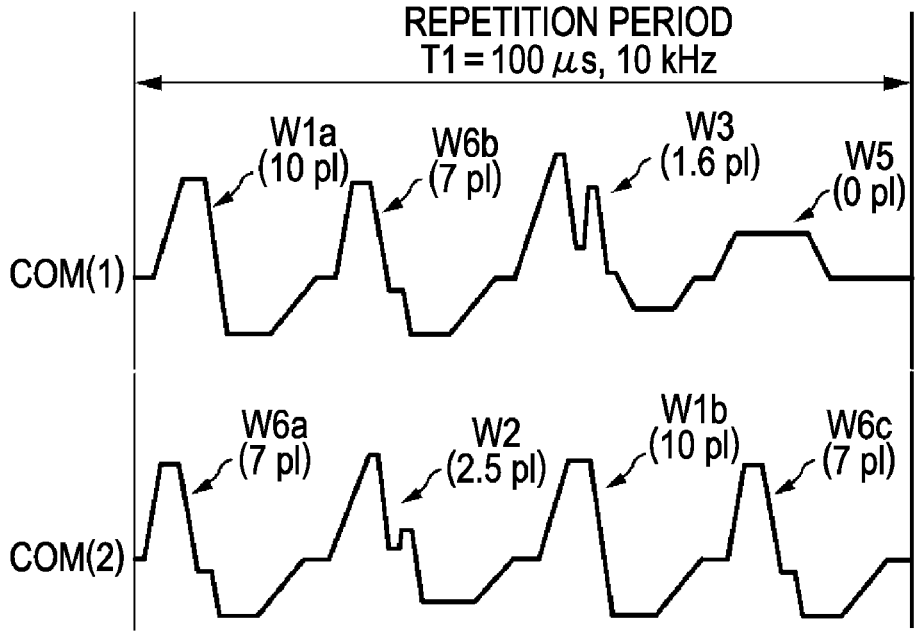
Figure 17:
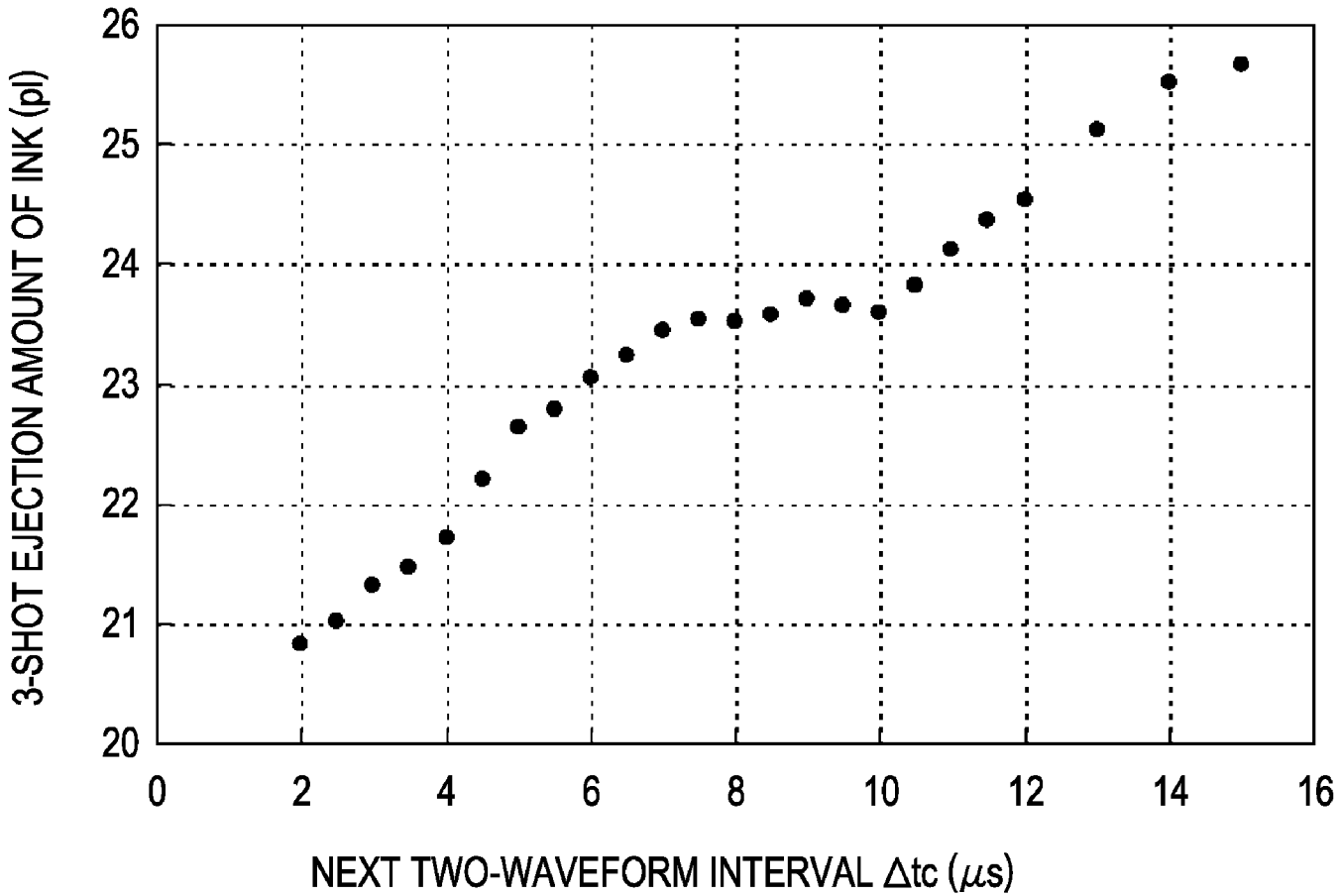
FIG. 17 is a diagram illustrating a measurement result of the ejection amount of ink when the generation interval of three amount decreasing waveforms is varied a plural number of times.

FIG. 16A is a diagram illustrating three amount decreasing waveforms W6 in the repetition period T1 (100 μs) according to a modified example. FIG. 16B is a diagram illustrating the driving signal COM including three amount decreasing waveforms W6 according to a modified example. FIG. 17 is a diagram illustrating a measurement result of the ejection amount of ink when a waveform interval Δtc of a second amount decreasing waveform W6*b* and a third amount decreasing waveform W6*c* is adjusted and the three amount decreasing waveforms W6 are applied to the piezoelectric element in each repetition period T1. In the above-described embodiment (see FIG. 12), the two basic waveforms W1 and the two amount decreasing waveforms W6 in the repetition period T1 are generated, but the invention is not limited thereto. For example, three or more amount decreasing waveforms W6 may be generated.

As shown in FIG. 16A, the waveform interval Δta of the two amount decreasing waveforms W6*a* and W6*b* generated in the repetition period T1 is set so that the ink of 14 pl (7 pl×2) is ejected by the two amount decreasing waveforms W6*a* and W6*b*, as in the above-described driving signal COM. By varying the waveform interval Δtc of the two amount decreasing waveforms W6*b* and W6*c* generated subsequently in the repetition period T1*a* plural number of times, the amount of ink ejected from the nozzle by the three amount decreasing waveforms is measured, as in FIG. 9. As a consequence, from FIG. 17, it can be known that the amount of ink is varied at the waveform interval Δtc of the subsequent two amount decreasing waveforms W6*b* and W6*c*. In the result of FIG. 17, the driving signal COM shown in FIG. 16A is generated repeatedly and the amount of ink in the repetition period T1 subsequent to the second period is used.

By adjusting the waveform interval of the three amount decreasing waveforms W6*a*, W6*b*, and W6*c* (when the waveform interval Δtc is set to about 2.5 μs in the result of FIG. 17), it is possible to eject the amount of ink of "21 pl", which is triple the amount of ink of 7 pl ejected by one amount decreasing waveform W6. Even when the three amount decreasing waveforms W6 are generated in the repetition period T1, the generation interval of the basic waveform W1 (corresponding to a first driving waveform) configured to eject the ink of 10 pl is closer to the half period of the repetition period T1 than the generation interval of the amount decreasing waveform W6 (corresponding to a second driving waveform).

FIG. 16B shows the example of the driving signals COM (1) and COM(2) used in effect. According to the driving signals, seven kinds of dots (1.6 pl, 2.5 pl, 7 pl, 10 pl, 14 pl, 20 pl, and 21 pl) can be formed and one pixel can thus be expressed by eight gray scales. In the driving signals, since the dot of 14 pl between the dot of 10 pl formed by one basic waveform W1 and the dot of 20 pl formed by two basic waveforms W1 can be formed, the granularity of the print image can be improved. Alternatively, by lengthening the repetition period (for example, 120 μs), a waveform W7 for 1 pl may be generated at the position of the waveform W5 for the minute vibration of the driving signal COM shown in FIG. 16B, and the waveform W5 for the minute vibration may be generated after the third amount decreasing waveform W6*c*.

From FIG. 17, it can be known that the amount of ink larger than 21 pl may be ejected by lengthening the waveform interval Δtc of two subsequent driving waveforms Wb and Wc in the repetition period T1. Accordingly, the invention is not limited to the method of forming the dot of 21 pl in the three amount decreasing waveforms Wa, Wb, and Wc. For example, by increasing the amount of ink, a dot of 23 pl or a dot of 24 pl may be formed. In this way, since the larger dot can be formed, the image can be formed without a gap in the solid printing or the print time can be shortened.

Other Embodiments

In the above-described embodiment, a print system including the ink jet printer has mainly been described, but the disclosure regarding the driving signal or the like is also included. The above-described embodiment has been described for easy understanding of the invention and should not be construed as limiting the invention. The invention may be modified or improved without departing the gist of the invention and the equivalents are of course included in the invention. In particular, the following embodiments are also included in the invention.

Driving Waveform

In the above-described embodiment, the head 41 (see FIGS. 2A and 2B) has been used which includes the pressure chamber 412*d* expanding when the potential applied to the driving element increases and the pressure chamber 412*d* contracting when the potential applied to the driving element decreases. However, the invention is not limited thereto. For example, the pressure chamber may contract when the potential applied to the driving element increases. The pressure chamber may expand when the potential applied to the driving element decreases. In this case, a driving waveform formed by inverting the driving waveform W in FIG. 11 may be used.

Line Printer

In the above-described embodiment, the printer 1 has been exemplified which alternately performs the image forming process of ejecting ink droplets while moving the head 41 in the moving direction and the transporting operation of transporting the medium. However, the invention is not limited thereto. For example, a line head printer may be used in which the plural nozzles are arranged in a direction intersecting the transporting direction of the medium and the head ejects ink droplets toward the medium transported below the head to form an image.

Liquid Ejecting Apparatus

In the above-described embodiment, the ink jet printer has been described as the liquid ejecting apparatus, but the invention is not limited thereto. The liquid ejecting apparatus is applicable to various industrial apparatuses, not to the printer (printing apparatus). For example, the invention is applicable to a printing apparatus attaching a shape to a cloth, a display manufacturing apparatus such as a color filter manufacturing apparatus or an organic EL display, a DNA chip manufacturing apparatus manufacturing a DNA chip by applying a solution, in which DNA is solved, to a chip, and the like. A fluid is not limited to the liquid, but a powder or the like may be used.

As a method of ejecting the fluid, a piezoelectric method may be used by ejecting the fluid by expanding and contracting an ink chamber. A thermal method may be used by generating bubbles in nozzles by a heating element and ejecting a fluid by the bubbles.

What is claimed is:

1. A liquid ejecting apparatus comprising:

a driving element which is driven by a driving waveform;

a nozzle from which a liquid is ejected by driving the driving element;

a driving signal generator which generates a plurality of the driving waveforms in a predetermined repetition period and creates a driving signal in which the plurality of driving waveforms is repeatedly generated in each predetermined repetition period; and a controller which permits the driving signal generator to create the driving signal in which at least two first driving waveforms are configured to eject the maximum amount of liquid among amounts of liquid ejected from the nozzle once in the predetermined repetition period and at least two second driving waveforms, different from the at least two first driving waveforms, configured to eject an amount of liquid different from the maximum amount of liquid are generated in each predetermined repetition period, the driving signal being generated such that a temporal interval at which the first driving waveform is generated is closer to a half length of the predetermined repetition period than a temporal interval at which the second driving waveform is generated.

2. A liquid ejecting apparatus according claim 1, the temporal interval at which the second driving waveform is set that an amount of liquid ejected by two second waveforms equals to twice of an amount of liquid ejected by one second wave form.

* * * * *